US006937829B2

(12) United States Patent
Sato et al.

(10) Patent No.: US 6,937,829 B2
(45) Date of Patent: Aug. 30, 2005

(54) IMAGE FORMING APPARATUS CAPABLE OF DELIVERING TAB SHEETS

(75) Inventors: Mitsuhiko Sato, Chiba (JP); Eiichi Motoyama, Tokyo (JP); Shokyo Koh, Ibaraki (JP); Hideyuki Ikegami, Chiba (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/668,108

(22) Filed: Sep. 22, 2003

(65) Prior Publication Data

US 2004/0136745 A1 Jul. 15, 2004

(30) Foreign Application Priority Data

Sep. 24, 2002 (JP) ..... 2002-277082

(51) Int. Cl.[7] ..... G03G 15/00

(52) U.S. Cl. ..... 399/82; 399/361; 399/382; 399/405

(58) Field of Search ..... 399/81, 82, 361, 399/381, 382, 391, 405

(56) References Cited

U.S. PATENT DOCUMENTS 5,257,080 A * 10/1993 Johroku et al. ..... 399/405
5,655,207 A * 8/1997 Sugiyama et al. ..... 399/382
6,393,232 B1 * 5/2002 Osari et al. ..... 399/82
6,553,193 B1 * 4/2003 Takara ..... 399/82
6,571,072 B1 * 5/2003 Sugimoto ..... 399/81
2002/0018665 A1 * 2/2002 Muto ..... 399/85

* cited by examiner

*Primary Examiner*—Sandra L. Brase
(74) *Attorney, Agent, or Firm*—Rossi, Kimms & McDowell LLP

(57) ABSTRACT

There is provided an image forming apparatus capable of setting up a tab sheet mode-operating and configuring environment in which an effective tab sheet mode output can be obtained by simple selecting and designating operations, A designating device designates a type of sequence of tabs of each of tab sheet bundles set in the sheet feed devices such as cassettes 21*a*–21*d* and multi manual feed tray 27 etc. A determining device is responsive to a user's instruction for feeding tab sheets and selection of a combination of one of the sheet feed devices and one of the sheet discharge devices such as face-up discharge tray 2 and face-down discharge tray 3, for determining whether a combination of the selected sheet feed device, the selected sheet discharge device, and the type of sequence of tabs of the tab sheet bundle set in the selected sheet feed device is valid or not.

10 Claims, 16 Drawing Sheets

*FIG. 8*

| DISCHARGE TRAY | FACE-DOWN TRAY | | FACE-UP TRAY | |
|---|---|---|---|---|
| FEED TRAY | CASSETTE 21a | DECK 28 | CASSETTE 21a | DECK 28 |
| PAGE OUTPUT ORDER | FIRST PAGE FIRST | FIRST PAGE FIRST | LAST PAGE FIRST | LAST PAGE FIRST |
| PAGE ORDER | REVERSE | NORMAL | NORMAL | REVERSE |

FIG. 18

STORAGE MEDIUM (FD/CD-ROM, ETC.)

| |
|---|
| DIRECTORY INFORMATION |
| FIRST DATA PROCESSING PROGRAM PROGRAM CODE GROUP CORRESPONDING TO STEPS OF FLOWCHART SHOWN IN FIG. 9 |
| SECOND DATA PROCESSING PROGRAM PROGRAM CODE GROUP CORRESPONDING TO STEPS OF FLOWCHART SHOWN IN FIGS. 16 AND 17 |
| |

MEMORY MAP OF STORAGE MEDIUM

IMAGE FORMING APPARATUS CAPABLE OF DELIVERING TAB SHEETS

BACKGROUND OF THE INVENTION

1. Field of the Invention

The present invention relates to an image forming apparatus that has a tab-inserting function of delivering a bundle of recording sheets with tab sheets inserted therein.

2. Description of the Related Art

Conventionally, image forming apparatuses, such as copying machines and printers, are provided with a plurality of feed trays, and are capable of forming images on sheets having different sizes and outputting the same. Further, the feed trays include a front-loading tray which is disposed in the body of the image forming apparatus and pulled out toward the user to set sheets therein, a deck which is disposed outside the body of the apparatus and capable of containing a large number of sheets, and a multi tray which is capable of having irregularly-sized sheets set therein.

Further, a sheet fed from the front-loading tray is conveyed via a U-shaped conveying path to an image transfer position, and therefore an image is transferred onto the lower surface of the sheet. On the other hand, a sheet fed from the deck or the multi tray is linearly supplied to the image transfer position, and therefore an image is transferred onto the upper surface of the sheet. That is, whether an image is transferred onto the upper surface of a sheet or the lower surface of a sheet depends on a path via which the sheet is fed.

Further, these feed trays can have stacked thereon not only plain paper, but also various types of materials, such as thick paper, OHP sheets, glossy paper, and envelopes. Tab sheets are among them. The tab sheets are formed with tabs for division of sheets, and a bundle of table sheets is comprised of a plurality of tab sheets arranged such that the respective locations of tabs on the tab sheets are sequentially shifted from an uppermost location to a lowermost location. For example, there are three-tab sheets formed by three sheets each formed with a tab, and five-tab sheets formed by five sheets each formed with a tab. One set of three-tab sheets is comprised of three tab sheets, and one set of five-tab sheets is comprised of five tab sheets. In general, the tab sheets forming one set are sequentially named a first page, a second page, a third page, . . . , starting with a sheet formed with a tab at the uppermost location.

On the other hand, the image forming apparatus is also provided with a plurality of discharge trays for discharging sheets. Particularly, for a multifunction machine, which has a copying function, a printing function, a facsimile function, and so forth, integrated in a single unit, it is an essential requirement to have a plurality of discharge trays for sorting sheets discharged by these functions.

The discharge trays are largely classified into a face-up tray onto which sheets are discharged with an image-transferred surface thereof facing upward, and a face-down tray onto which sheets are discharged with an image-transferred surface thereof facing downward.

Trays often used in conventional copying machines, which allow sheets to be linearly discharged out in a conveying direction, are examples of the face-up tray, and trays often used in conventional printers, which are disposed at the top of the printers and allows sheets to be discharged, are examples of the face-down tray.

When a bundle of sheets are discharged onto the face-up tray or the face-down tray, since a new sheet is stacked on sheets already stacked on the discharge tray, the order of output of pages is different between the face-up tray and the face-down tray. Normally, onto the face-up tray, sheets are discharged starting with the last page first, whereas onto the face-down tray, sheets are discharged starting with the first page first.

To this end, depending on the type of discharge trays onto which sheets are to be discharged, control is provided such that the order of pages to be output is switched over. Further, some image forming apparatuses are capable of inverting sheets printed with images during conveyance thereof inside the machine, to use a face-up tray as a face-down tray.

Further, as for tab sheets, even when they are discharged onto the face-up tray, they are discharged starting with the first page of a tab sheet bundle, so that the order of tabs in the tab sheet bundle discharged onto the face-up tray is reversed. To eliminate this inconvenience, some commercially available tab sheets are provided, which are already reversed in the order of pages of a tab sheet bundle. A bundle of tab sheets stacked in a normal page order is called a normal tab sheet bundle. The first page of the normal tab sheet bundle has a tab formed at an uppermost location of a right-hand side thereof, and the following pages each have a tab formed at a lower location than the location of a tab on the immediately preceding page. A bundle of tab sheets stacked in a reverse page order is called a reverse tab sheet bundle. The last page of the reverse tab sheet bundle has a tab formed at an uppermost location of a right-hand side thereof, and the preceding pages each have a tab formed at a lower location than the location of a tab on the immediately following page.

The conventional image forming apparatuses are constructed as described above, and therefore, to print on tab sheets, if they are to be discharged onto the face-up tray, it is only necessary to use a reverse tab sheet bundle, whereas if they are to be discharged onto the face-down tray, it is only necessary to use a normal tab sheet bundle.

This did not raise any problems insofar as sheets could be fed only from trays that contain sheets to be conveyed to the image transfer position without being inverted or made upside down. With the progress of the sheet conveying technique, however, it has become technically possible to convey any type of material, and tab sheets can be also conveyed even from front-loading trays from which sheets are fed to be inverted during conveyance, causing the page order of the tab sheets to be reversed. Therefore, when users want to print on tab sheets, it is necessary to set a suitable type of tab sheets in a feed tray, after considering whether the sheets are inverted in the conveying path from the feed tray to the image transfer position, or in the conveying path from the image transfer position to a discharge tray. This increases the operating burden on the users, and there is a fear of producing a heap of misprints, before tab sheets are discharged as desired, which raises a problem in operating the conventional image forming apparatuses.

SUMMARY OF THE INVENTION

It is an object of the present invention to provide an image forming apparatus which is capable of setting up a tab sheet mode-operating and configuring environment in which an effective tab sheet mode output can be obtained by simple selecting and designating operations, without the user being conscious of manners of output of the tab sheet bundle dependent on tab sheet setting, thereby limiting wasteful image formation due to errors in a tab sheet mode process as occurring in the prior art, to save paper resources.

To attain the above object, in a first aspect of the present invention, there is provided an image forming apparatus capable of feeding tab sheets of a predetermined tab sheet bundle or other sheets than the tab sheets, comprising a first sheet feed device that feeds each of the tab sheets of the predetermined tab sheet bundle or the other sheets to an image transfer position via a first conveying path with the tab sheet being inverted, a second sheet feed device that feeds each of the tab sheets of the predetermined tab sheet bundle or the other sheets to the image transfer position via a second conveying path without each sheet being inverted, a first sheet discharge device that discharges each of the tab sheets of the predetermined tab sheet bundle or the other sheets in a face-up state, a second sheet discharge device that discharges each of the tab sheets of the predetermined tab sheet bundle or the other sheets in a face-down state, a designating device that designates a type of sequence of tabs of each of tab sheet bundles set in the first sheet feed device and the second sheet feed device, and a determining device responsive to a user's instruction for feeding tab sheets and selection of a combination of one of the first sheet feed device and the second sheet feed device and one of the first sheet discharge device and the second sheet discharge device, for determining whether a combination of the selected one of the first sheet feed device and the second sheet feed device, the selected one of the first sheet discharge device and the second sheet discharge device, and the type of sequence of tabs of the tab sheet bundle set in the selected one of the first sheet feed device and the second sheet feed device is valid or not.

With the arrangement of the image forming apparatus according to the first aspect of the present invention, it is possible to set up a tab sheet mode-operating and configuring environment in which an effective tab sheet mode output can be obtained by simple selecting and designating operations, without the user being conscious of manners of output of the tab sheet bundle dependent on tab sheet setting, thereby limiting wasteful image formation due to errors in a tab sheet mode process as occurring in the prior art, to save paper resources.

Preferably, the image forming apparatus further comprises a control device that provides control to decide whether to allow or inhibit image forming according to the user's selection of the combination of the one of the first sheet feed device and the second sheet feed device and the one of the first sheet discharge device and the second sheet discharge device, based on a result of the combination-validity determination by the determining device.

To attain the above object, in a second aspect of the present invention, there is provided an image forming apparatus capable of feeding tab sheets of a predetermined tab sheet bundle or other sheets than the tab sheets, comprising a first sheet feed device that feeds each of the tab sheets of the predetermined tab sheet bundle or the other sheets to an image transfer position via a first conveying path with the tab sheet being inverted, a second sheet feed device that feeds each of the tab sheets of the predetermined tab sheet bundle or the other sheets to the image transfer position via a second conveying path without each sheet being inverted, a first sheet discharge device that discharges each of the tab sheets of the predetermined tab sheet bundle or the other sheets in a face-up state, a second sheet discharge device that discharges each of the tab sheets of the predetermined tab sheet bundle or the other sheets in a face-down state, a designating device that designates a type of sheets set in the first sheet feed device or the second sheet feed device, and when the designated type of sheets is a tab sheet bundle, designates a type of sequence of tabs of the tab sheet bundle, and a determining device responsive to a user's instruction for feeding tab sheets and selection of a combination of one of the first sheet feed device and the second sheet feed device and one of the first sheet discharge device and the second sheet discharge device, for determining whether a combination of the selected one of the first sheet feed device and the second sheet feed device, the selected one of the first sheet discharge device and the second sheet discharge device, and the type of sequence of tabs of the tab sheet bundle set in the selected one of the first sheet feed device and the second sheet feed device is valid or not.

With the arrangement of the image forming apparatus according to the second aspect of the present invention, it is possible to obtain the same advantageous effects as provided by the image forming apparatus according to the first aspect of the present invention.

Preferably, the image forming apparatus further comprises a control device that controls, based on a result of the combination-validity determination by the determining device, whether to allow or inhibit image forming according to the user's selection of the combination of the one of the first sheet feed device and the second sheet feed device and the one of the first sheet discharge device and the second sheet discharge device.

To attain the above object, in a third aspect of the present invention, there is provided an image forming apparatus capable of feeding tab sheets of a predetermined tab sheet bundle or other sheets than the tab sheets, comprising a first sheet feed device that feeds each of the tab sheets of the predetermined tab sheet bundle or the other sheets to an image transfer position via a first conveying path with the tab sheet being inverted, a second sheet feed device that feeds each of the tab sheets of the predetermined tab sheet bundle or the other sheets to the image transfer position via a second conveying path without each sheet being inverted, a first sheet discharge device that discharges each of the tab sheets of the predetermined tab sheet bundle or the other sheets in a face-up state, a second sheet discharge device that discharges each of the tab sheets of the predetermined tab sheet bundle or the other sheets in a face-down state, a designating device that designates a type of sequence of tabs of each of tab sheet bundles set in the first sheet feed device and the second sheet feed device, and a determining device responsive to a user's instruction for feeding tab sheets and selection of one of the first sheet feed device and the second sheet feed device, for determining which of the first sheet discharge device and the second sheet discharge device is allowed to be selected by a user, according to the selected one of the first sheet feed device and the second sheet feed device and the type of sequence of tabs of the tab sheet bundle set in the selected one of the first sheet feed device and the second sheet feed device.

With the arrangement of the image forming apparatus according to the third aspect of the present invention, it is possible to obtain the same advantageous effects as provided by the image forming apparatus according to the first aspect of the present invention.

To attain the above object, in a fourth aspect of the present invention, there is provided an image forming apparatus capable of feeding tab sheets of a predetermined tab sheet bundle or other sheets than the tab sheets, comprising a first sheet feed device that feeds each of the tab sheets of the predetermined tab sheet bundle or the other sheets to an image transfer position via a first conveying path with the tab sheet being inverted, a second sheet feed device that feeds each of the tab sheets of the predetermined tab sheet bundle or the other sheets to the image transfer position via a second conveying path without each sheet being inverted, a first sheet discharge device that discharges each of the tab sheets of the predetermined tab sheet bundle of the predetermined tab sheet bundle or the other sheets in a face-up state, a second sheet discharge device that discharges each of the tab sheets of the predetermined tab sheet bundle of the predetermined tab sheet bundle or the other sheets in a face-down state, a designating device that designates a type of sequence of tabs of each of tab sheet bundles set in the first sheet feed device and the second sheet feed device, and a determining device responsive to a user's instruction for feeding tab sheets and selection of one of the first sheet discharge device and the second sheet discharge device, for determining which of the first sheet feed device and the second sheet feed device is allowed to be selected by a user, according to the selected one of the first sheet discharge device and the second sheet discharge device and the type of sequence of tabs of each of the tab sheet bundles set in the first sheet feed device and the second sheet feed device.

With the arrangement of the image forming apparatus according to the fourth aspect of the present invention, it is possible to obtain the same advantageous effects as provided by the image forming apparatus according to the first aspect of the present invention.

To attain the above object, in a fifth aspect of the present invention, there is provided an image forming apparatus capable of sequentially feeding tab sheets of a tab sheet bundle in a normal order or a reverse order, comprising a first sheet feed device that feeds each of the tab sheets of the tab sheet bundle to an image transfer position via a first conveying path while the tab sheet is inverted, a second sheet feed device that feeds each of the tab sheets of the tab sheet bundle to the image transfer position via a second conveying path without the tab sheet being inverted, a first sheet discharge device that discharges each of the tab sheets of the tab sheet bundle in a face-up state, a second sheet discharge device that discharges each of the tab sheets of the tab sheet bundle in a face-down state, and a control device responsive to selection of the first sheet discharge device, for inhibiting selection of feed devices other than the first sheet feed device in which the tab sheet bundle in the normal order is set and the second sheet feed device in which the tab sheet bundle in the reverse order is set.

With the arrangement of the image forming apparatus according to the fifth aspect of the present invention, it is possible to obtain the same advantageous effects as provided by the image forming apparatus according to the first aspect of the present invention.

To attain the above object, in a sixth aspect of the present invention, there is provided an image forming apparatus capable of sequentially feeding tab sheets of a tab sheet bundle in a normal order or a reverse order, comprising a first sheet feed device that feeds each of the tab sheets of the tab sheet bundle to an image transfer position via a first conveying path while the tab sheet is inverted, a second sheet feed device that feeds each of the tab sheets of the tab sheet bundle to the image transfer position via a second conveying path without the tab sheet being inverted, a first sheet discharge device that discharges each of the tab sheets of the tab sheet bundle in a face-up state, a second sheet discharge device that discharges each of the tab sheets of the tab sheet bundle in a face-down state, and a control device responsive to selection of the second sheet discharge device, for inhibiting selection of feed devices other than the first sheet feed device in which the tab sheet bundle in the reverse order is set and the second sheet feed device in which the tab sheet bundle in the normal order is set.

With the arrangement of the image forming apparatus according to the sixth aspect of the present invention, it is possible to obtain the same advantageous effects as provided by the image forming apparatus according to the first aspect of the present invention.

To attain the above object, in a seventh aspect of the present invention, there is provided an image forming apparatus capable of sequentially feeding tab sheets of a tab sheet bundle in a normal order or a reverse order, comprising a first sheet feed device that feeds each of the tab sheets of the tab sheet bundle to an image transfer position via a first conveying path while the tab sheet is inverted, a second sheet feed device that feeds each of the tab sheets of the tab sheet bundle to the image transfer position via a second conveying path without the tab sheet being inverted, a first sheet discharge device that discharges each of the tab sheets of the tab sheet bundle in a face-up state, a second sheet discharge device that discharges each of the tab sheets of the tab sheet bundle in a face-down state, and a control device responsive to selection of the first sheet feed device in which the tab sheet bundle in the normal order is set or the second sheet feed device in which the tab sheet bundle in the reverse order is set, for inhibiting selection of discharge devices other than the first sheet discharge device.

With the arrangement of the image forming apparatus according to the seventh aspect of the present invention, it is possible to obtain the same advantageous effects as provided by the image forming apparatus according to the first aspect of the present invention.

To attain the above object, in an eighth aspect of the present invention, there is provided an image forming apparatus capable of sequentially feeding tab sheets of a tab sheet bundle in a normal order or a reverse order, comprising a first sheet feed device that feeds each of the tab sheets of the tab sheet bundle to an image transfer position via a first conveying path while the tab sheet is inverted, a second sheet feed device that feeds each of the tab sheets of the tab sheet bundle to the image transfer position via a second conveying path without the tab sheet being inverted, a first sheet discharge device that discharges each of the tab sheets of the tab sheet bundle in a face-up state, a second sheet discharge device that discharges each of the tab sheets of the tab sheet bundle in a face-down state, and a control device responsive to selection of the first sheet feed device in which the tab sheet bundle in the reverse order is set or the second sheet feed device in which the tab sheet bundle in the normal order is set, for inhibiting selection of discharge devices other than the second sheet discharge device.

With the arrangement of the image forming apparatus according to the eighth aspect of the present invention, it is possible to obtain the same advantageous effects as provided by the image forming apparatus according to the first aspect of the present invention.

The above and other objects, features, and advantages of the present invention will become more apparent from the following detailed description taken in conjunction with the accompanying drawings.

BRIEF DESCRIPTION OF THE DRAWINGS

FIGS. 3A and 3B are views showing types of tab sheet bundles applicable to the image forming apparatus, in which FIG. 3A shows a normal tab sheet bundle, and FIG. 3B shows a reverse tab sheet bundle;

FIGS. 4A and 4B are views useful in explaining changes in the page order of a tab sheet bundle in a case where the tab sheets of a normal tab sheet bundle are conveyed through the image forming apparatus shown in FIG. 1 from a cassette to a face-up tray, in which FIG. 4A shows a conveying path via which the tab sheets are conveyed, and FIG. 4B shows a state of the tab sheets stacked in the cassette and a state of the same stacked in the face-up tray;

FIGS. 5A and 5B are views useful in explaining changes in the page order of a tab sheet bundle in a case where the tab sheets of a reverse tab sheet bundle are conveyed through the image forming apparatus shown in FIG. 1 from the cassette to a face-down tray, in which FIG. 5A shows a conveying path via which the tab sheets are conveyed, and FIG. 5B shows a state of the tab sheets stacked in the cassette and a state of the same stacked in the face-down tray;

FIGS. 6A and 6B are views useful in explaining changes in the page order of a tab sheet bundle in a case where the tab sheets of a reverse tab sheet bundle are conveyed through the image forming apparatus shown in FIG. 1 from a deck to the face-up tray, in which FIG. 6A shows a conveying path via which the tab sheets are conveyed, and FIG. 6B shows a state of the tab sheets stacked in the deck and a state of the same stacked in the face-up tray;

FIGS. 7A and 7B are views useful in explaining changes in the page order of a tab sheet bundle in a case where the tab sheets of a normal tab sheet bundle are conveyed through the image forming apparatus shown in FIG. 1 from the deck to the face-down tray, in which FIG. 7A shows a conveying path via which the tab sheets are conveyed, and FIG. 7B shows a state of the tab sheets stacked in the deck and a state of the same stacked in the face-down tray;

FIG. 8 is a diagram of a table showing proper combinations of feed tray type, discharge tray type, page output order, and tab sheet type, which enable the image forming apparatus to output tab sheets in a normal page order;

FIGS. 10A and 10B are views showing operating screens displayed on a display panel appearing in FIG. 2, in which FIG. 10A shows an operating screen in a standby state of the image forming apparatus, and FIG. 10B shows an operating screen for selecting a discharge tray

FIG. 18 is a diagram useful in explaining the structure of a memory map of a storage medium that stores various data processing programs which can be read out by the image forming apparatus shown in FIG. 1.

DETAILED DESCRIPTION OF THE PREFERRED EMBODIMENTS

The present invention will now be described in detail with reference to the accompanying drawings showing a preferred embodiment thereof.

Figure 1:
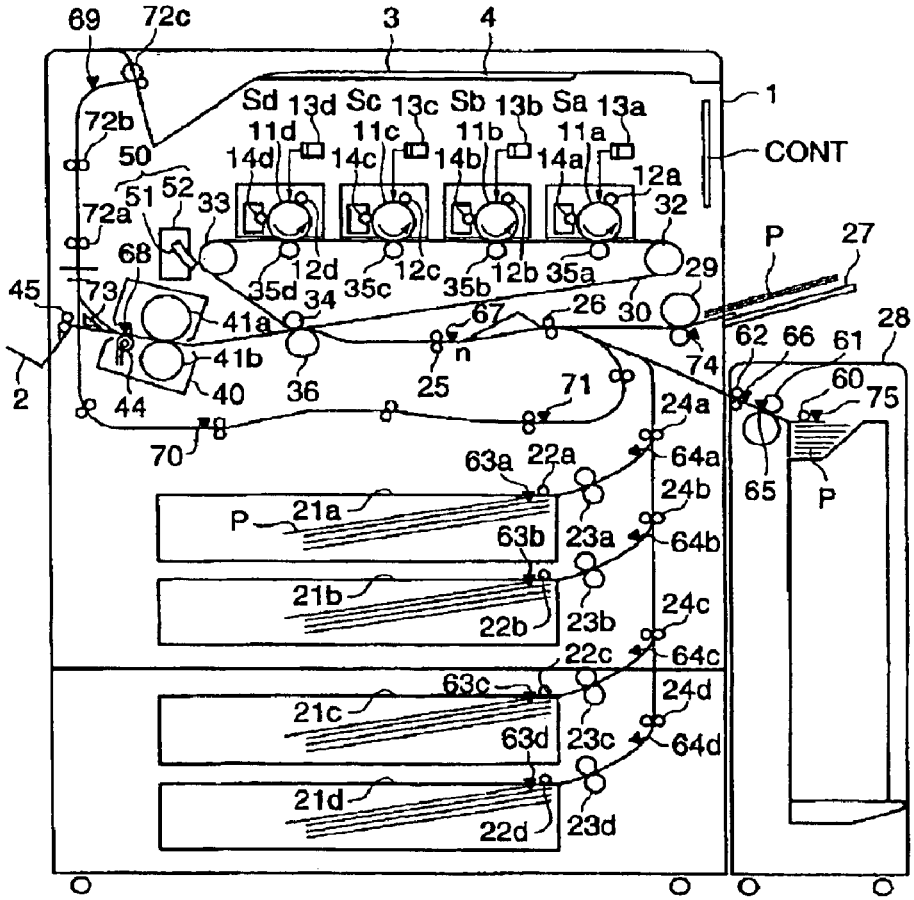
FIG. 1 is a longitudinal cross-sectional view schematically showing the arrangement of an image forming apparatus according to an embodiment of the present invention.

FIG. 1 is a longitudinal cross-sectional view schematically showing the arrangement of an image forming apparatus according to an embodiment of the present invention. The image forming apparatus according to the present embodiment is a 4-drum tandem color image-forming apparatus based on an electrophotographic method, which is capable of selectively using a multi-tray, 4-stage sheet feed cassettes, or a paper deck (also simply referred to as "the deck"), as a feed tray for feeding sheets.

In FIG. 1, reference numeral 1 designates the image forming apparatus. The image forming apparatus is broadly divided into an image forming section (comprised of four stations Sa, Sb, Sc, Sd which are juxtaposed and identical in construction), feed trays, an intermediate transfer section, a conveyor section, a fixing unit, an operating section, and a control unit (controller section, referred to hereinafter). Symbol CONT designates the controller section which is comprised of a controller board provided with a CPU, a RAM, a ROM, and so forth. The controller section CONT performs centralized control of the feed trays, the intermediate transfer section, the conveyor section, the fixing unit, and the operating section, based on control programs stored in the ROM. Further, the ROM stores a program for executing a process described in detail hereinafter with reference to FIG. 9.

Next, the individual units or aforementioned components of the image forming apparatus will be described in detail.

The image forming section is constructed as follows: Photosensitive drums 11*a*, 11*b*, 11*c*, 11*d* as image carriers are each rotatably supported on a central shaft and driven by a driving motor, not shown, for rotation in a direction indicated by an arrow. Roller chargers 12*a*, 12*b*, 12*c*, 12*d*, scanners 13*a*, 13*b*, 13*c*, 13*d*, and developing devices 14*a*, 14*b*, 14*c*, 14*d* are arranged in the direction of rotation of the photosensitive drums 11*a*, 11*b*, 11*c*, 11*d* in opposed relation to the peripheral surfaces of the photosensitive drums 11*a*, 11*b*, 11*c*, 11*d*, respectively. The roller chargers 12*a* to 12*d* uniformly electrify or charges the surfaces of the photosensitive drums 11*a* to 11*d* by the same amount of electrostatic charge.

The photosensitive drums 11*a* to 11*d* are exposed to light beams, such as laser beams, modulated according to recorded image signals by the respective associated scanners 13*a* to 13*d*, whereby electrostatic latent images are formed on the photosensitive drums 11*a* to 11*d*, respectively. Further, the electrostatic latent images are developed into visible images by the developing devices 14*a* to 14*d* containing developers (toners) of four colors, i.e. yellow, cyan, magenta and black, respectively, and then the obtained visible images are transferred onto an intermediate transfer belt 30. Thus, by the above described process, image forming is sequentially carried out by the toners of different colors.

Each feed tray is comprised of a part for receiving sheets P, a roller for conveying a sheet P, a sensor for detecting passage of a sheet P, a sensor for detecting the presence or absence of sheets P, and a guide (not shown) for guiding a sheet P via a conveying path.

Reference numerals 21*a*, 21*b*, 21*c*, 21*d* designate cassettes, reference numeral 27 a multi manual feed tray, and reference numeral 28 a deck. These feed trays hold sheets P. Reference numerals 22*a*, 22*b*, 22*c*, 22*d* designate pickup rollers for feeding sheets P one by one from the top of a stack of the sheets P from the associated cassettes 21*a* to 21*d*. The cassettes 21*a*, 21*b*, 21*c*, 21*d* are of the front loading type.

Although the pickup rollers 22*a* to 22*d* sometimes feed a plurality of sheets P together, in such a case, only the uppermost one is positively separated by the associated one of BC roller pairs 23*a*, 23*b*, 23*c*, 23*d*. The sheet P separated by the associated one of the BC roller pairs 23*a* to 23*d* is further conveyed by the associated one of pull-off roller pairs 24*a* to 24*d* and a pre-registration roller pair 26 to a registration roller pair 25. As is apparent from FIG. 1, sheets set in the cassettes 21*a*, 21*b*, 21*c*, 21*d* are conveyed to the registration roller pair 25 via respective U-shaped conveying paths. Therefore, an image is transferred onto the lower surface of each sheet, i.e. a surface thereof which faces downward when the sheet is in the cassette 21*a*, 21*b*, 21*c*, or 21*d*.

Sheets P received in the manual feed tray 27 are fed such that only the uppermost one of the sheets P is separated by a BC roller 29 and conveyed by the pre-registration roller pair 26 to the registration roller pair 25. Further, sheets P received in the deck 28 are fed such that more than one sheet are conveyed by a pickup roller 60 to a sheet feed roller 61, and then only the uppermost one of them is positively separated by the sheet feed roller 61, followed by being carried to a pull-off roller pair 62. Further, the sheet P is conveyed by the pre-registration roller pair 26 to the registration roller pair 25. In the case of sheets fed from a manual feed tray 27 or the deck 28, an image is transferred onto the upper surface of each sheet, i.e. a surface thereof which faces upward when the sheet is in the manual feed tray 27 or the deck 28.

Next, the intermediate transfer section will be described in detail.

The intermediate transfer belt 30 is formed e.g. of PET (polyethylene terephthalate) or PVdF (polyvinylidene fluoride). Reference numeral 32 designates a driving roller for transmitting a driving force to the intermediate transfer belt 30. The intermediate transfer belt 30 is supported by the driving roller 32, a tension roller 33 for giving an adequate tension to the intermediate transfer belt 30 by the urging force of a spring (not shown), and a driven roller 34 cooperating with a secondary transfer roller 36, referred to hereinafter, to sandwich the intermediate transfer belt 30 therebetween, thereby forming a secondary transfer region.

The driving roller 32 is formed by a metal roller coated with rubber (urethane or chloroprene) of a thickness of several millimeters, so as to prevent slippage of the driving roller 32 on the intermediate transfer belt 30. The driving roller 32 is driven for rotation by a stepper motor (not shown). Primary transfer rollers 35*a* to 35*d* are arranged at respective locations in opposed relation to the associated photosensitive drums 11*a* to 11*d* via the intermediate transfer belt 30 interposed therebetween, and have a high voltage applied thereto for transferring toner images from the associated photosensitive drums 11*a* to 11*d* onto the intermediate transfer belt 30. The secondary transfer roller 36 is disposed in opposed relation to the driven roller 34, and the secondary transfer region is formed by a nip between the intermediate transfer belt 30 and the two rollers. The secondary transfer roller 36 is pressed against the intermediate transfer belt 30 by an adequate pressure.

At a location downstream of the secondary transfer region on the intermediate transfer belt 30, there is disposed a cleaning device 50 for cleaning an image-forming surface of the intermediate transfer belt 30. The cleaning device 50 is comprised of a cleaner blade 51 (formed e.g. of polyurethane rubber) and a waste toner box 52 for receiving waste toners.

The fixing unit 40 is comprised of a fixing roller 41*a* containing a heat source, such as a halogen heater, a roller 41*b* (which can also contain a heat source) pressed against the roller 41*a*, and an inner sheet discharge roller 44 for conveying a sheet P discharged from the roller pair 41*a*, 41*b*.

A sheet P conveyed to the registration roller pair 25 is temporarily stopped by stopping rotations of the rollers upstream of the registration roller pair 25, and then these rollers including the registration roller pair 25 are driven again for restarting rotation in synchronism with an image forming operation by the image forming section. As a result, the sheet P is sent to the secondary transfer region, described in detail hereinafter.

The sheet P has an image transferred thereon in the secondary transfer region and fixed by the fixing unit 40, and then passes the inner sheet discharge roller 44. Thereafter, the sheet conveyance direction is switched by a switching flapper 73. When the switching flapper 73 has been switched to a face-up discharge side, the sheet P is discharged onto a face-up discharge tray (hereinafter referred to as "the face-up tray) 2 by an outer sheet discharge roller pair 45.

On the other hand, when the switching flapper 73 has been switched to a face-down discharge side, the sheet P is conveyed toward inverting roller pairs 72*a*, 72*b*, 72*c* and discharged onto a face-down discharge tray (hereinafter referred to as "the face-down tray) 3.

On the conveying paths of sheets P, there are arranged a plurality of sensors for detecting passage of a sheet P. The sensors include sheet feed retry sensors 64*a*, 64*b*, 64*c*, 64*d*, a deck sheet feed sensor 65, a deck pull-off sensor 66, a registration sensor 67, an inner sheet discharge sensor 68, a face-down sheet discharge sensor 69, a double-sided pre-registration sensor 70, and a double-sided sheet re-feed sensor 71.

The cassettes 21*a* to 21*d* for containing sheets P are provided with respective cassette sheet presence/absence sensors 63*a*, 63*b*, 63*c*, 63*d* for detecting the presence or absence of sheets P, and the manual feed tray 27 is provided with a manual feed tray sheet presence/absence sensor 74 for detecting the presence or absence of sheets P on the manual feed tray 27. Further, the deck 28 is provided with a deck sheet presence/absence sensor 75 for detecting the presence or absence of sheets P in the deck 28.

The control unit includes the controller board (not shown) for controlling operations of mechanisms within the above described units, and a motor drive board (not shown).

The operating section 4 is disposed in the top of the image forming apparatus 1, and make it possible to select a desired one of the feed trays (the sheet feed cassettes 21*a* to 21*d*, the manual feed tray 27, and the deck 28) containing sheets (transfer material), select a desired one of the sheet discharge trays (the face-up tray 2, and the face-down tray 3), and designate the type of a tab sheet bundle.

Next, a description will be given of the operation of the image forming apparatus 1. In the following, how sheets P are conveyed from the cassette 21*a* will be described as an example of the operation of the image forming apparatus 1.

When a predetermined time period has elapsed after generation of an image forming operation start signal, first, sheets P are sent out one by one from the cassette 21*a*. Then, each sheet P is fed by the sheet feed roller pair 23*a* and conveyed to the registration roller pair 25 via the pull-off roller pair 24*a* and the pre-registration roller pair 26. During this operation, the registration roller pair 25 is in stoppage, and hence the leading end of the sheet P abuts on a nip portion of the registration roller pair 25.

Thereafter, the registration roller pair 25 starts rotation in timing synchronous with the start of image formation by the image forming section. This start of rotation of the registration roller pair 25 is timed such that the sheet P and a toner image primarily transferred onto the intermediate transfer belt 30 by the image forming section meet in the secondary transfer region, in proper alignment.

On the other hand, in the image forming section, when the image forming operation start signal is generated, a toner image formed on the photosensitive drum 11*d* upstreammost in the direction of rotation of the intermediate transfer belt 30 is primarily transferred by the process described hereinabove onto the intermediate transfer belt 30 in a primary transfer region by the transfer roller 35*d* having a high voltage applied thereto. The primarily transferred toner image is conveyed to the next primary transfer region (i.e. primary transfer region formed by the photosensitive drum 11*c* and the transfer roller 35*c*).

In each primary transfer region, image formation is performed with a time delay corresponding to a time period for conveying the toner image from one station to another station, and a second toner image is transferred over the first toner image, with the leading end of the second toner image being aligned with that of the first toner image. In each of the following primary transfer regions, similar processing is carried out, and as a result, a toner image of four colors is primarily transferred onto the intermediate transfer belt 30.

Then, when the sheet P enters the second transfer region and comes into contact with the intermediate transfer belt 30, a high voltage is applied to the secondary transfer roller 36 in timing synchronous with the passage of the sheet P, whereby the four-color toner image formed on the intermediate transfer belt 30 by the above described process is transferred onto the surface of the sheet P. Thereafter, the sheet P is guided to the nip portion of the fixing roller 41*a*. The toner image is fixed on the sheet surface by the heat of the roller pair 41*a*, 41*b* and the pressure of the nip. Then, the sheet P is discharged onto the face-up tray 2 or the face-down tray 3 according to a direction selected by the switching flapper 73.

It should be noted that an original reader, not shown, for reading an image of an original and converting the same into image data is connected to the image forming apparatus 1.

Next, the operating section 4 appearing in FIG. 1 will be described with reference to FIG. 2.

Figure 2:
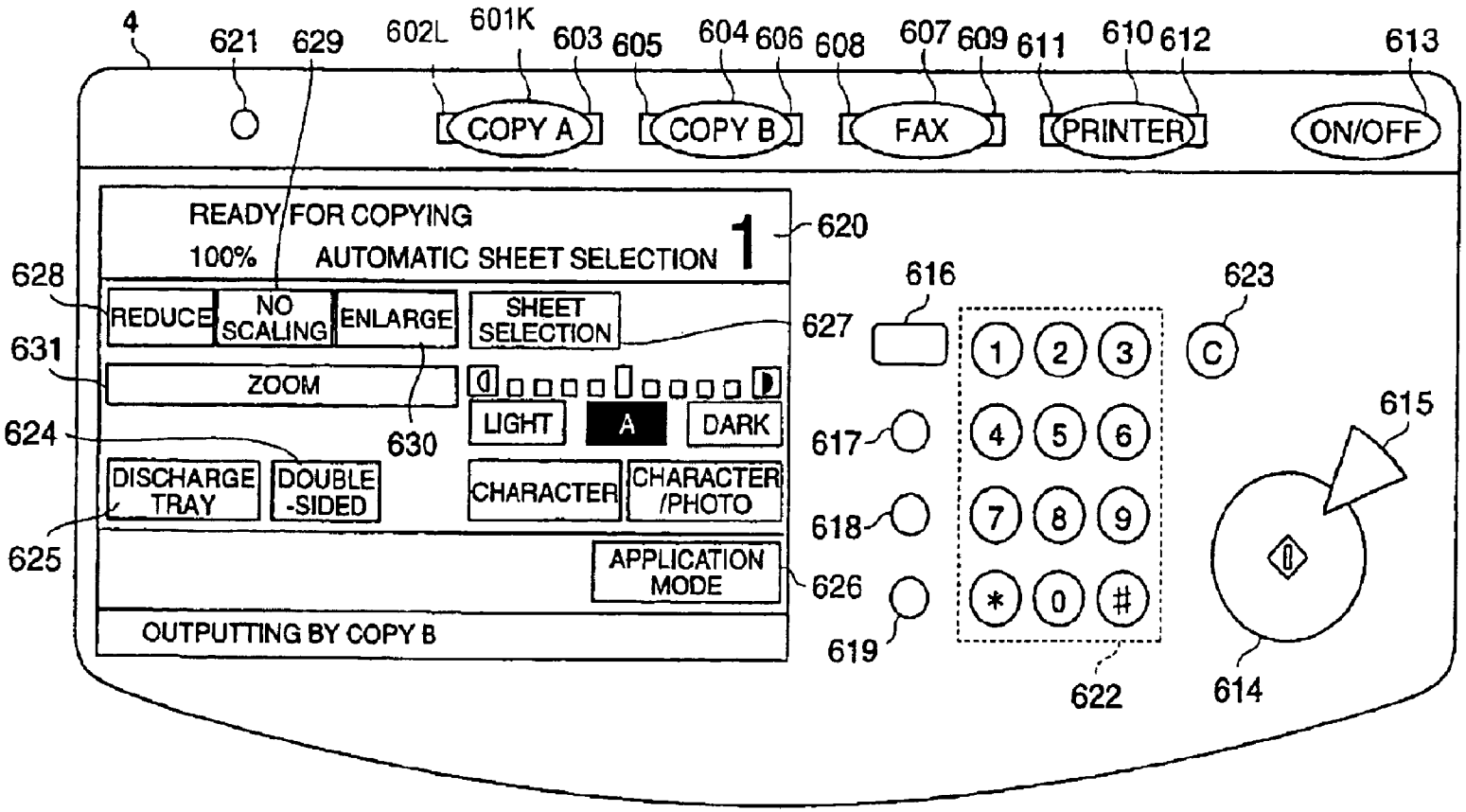
FIG. 2 is a plan view showing the layout of an operating section of the image forming apparatus shown in FIG. 1.

FIG. 2 is a plan view showing the layout of the operating section 4.

In FIG. 2, reference numeral 621 designates a power lamp for indicating that the power is on. Reference numeral 613 designates a power switch. The power lamp 621 is lighted or extinguished in accordance with switching between the power ON and the power OFF by the power switch 613. Reference numeral 622 designates a ten-key pad for use in setting the number of sheets for image formation and entering numerical values for setting a mode. Further, the ten-key pad 622 is used for entering a telephone number in a facsimile configuration screen.

Reference numeral 623 designates a clear key for clearing settings entered via the ten-key pad 622. Reference numeral 616 designates a reset key for resetting the number of sheets on which an image is to be formed, an operation mode, a selected feed tray, and so forth, set for image formation, to respective default values.

Reference numeral 614 designates a start key. An image forming operation is started by depressing the start key 614. The start key 614 has red and green LEDs (not shown) arranged in its center, for indicating whether or not the image forming operation can be started. When the operation is not permitted, the red LED is lighted, whereas when the same is permitted, the green LED is lighted. Reference numeral 615 designates a stop key for use in stopping a copying operation.

Reference numeral 617 designates a guide key. When another key is depressed after depression of the guide key 617, a description of a function that can be set by the depressed key is displayed on a display panel. This guidance display can be canceled by depressing the guide key 617 again.

Reference numeral 618 designates a user configuration key. By depressing this key, a user can configure settings of the image forming apparatus. Settings that the user is allowed to configure include a time period before a user's configuration is automatically cleared, and default values of modes, automatically set when the reset key 616 is depressed, for example. Reference numeral 619 designates an interruption key. By depressing this key during an image forming operation, it is possible to suspend the image forming operation and carry out a copying operation.

Reference numeral 620 designates the display panel implemented e.g. by a liquid crystal. The contents of the display are changed according to a mode to be set so as to facilitate configuration of details of settings of the mode. Further, the surface of the display panel 620 is configured to function as a touch sensor. In FIG. 2, an operating screen for a copying operation mode is displayed on the display panel 620.

Within the display panel 620, there are displayed keys 624 to 631. When a portion displaying each key is touched, depression of the key is sensed whereby the mode is configured. The reference numeral 624 designates a key for setting a double-sided operation mode. For example, the key 624 allows setting of three kinds of double-sided operation modes, i.e. a "single-to-double mode" for carrying out double-side output based on a single-sided original, a "double-to-double mode" for carrying out double-side output based on a double-sided original, and a "double-to-single mode" for carrying out two single-side outputs based on a double-sided original.

Reference numeral 625 designates a discharge tray selection key. By depressing this key, it is possible to select one of the face-up tray and the face-down tray for discharging sheets. Reference numeral 626 designates a key for setting an application mode. When this key is depressed, a screen for setting an applied function mode, such as a multiple operation mode, a reduced layout mode, a cover mode, or an interleaved sheet mode, is displayed on the display panel, and on the screen, configuration keys for respective applied function modes are displayed e.g. as shown FIG. 11, thereby enabling the user to set the application mode.

Reference numeral 627 designates a key for selecting a sheet feed stage. When this key is depressed, a selection screen for selecting one of the cassettes 21*a* to 21*d*, the deck 28, and the manual feed tray 27 as a feed tray is displayed on the display panel 620. Reference numerals 628 to 631 are for setting a copying magnification in a copying operation.

The keys in the display panel 620 are not only displayed in an ordinary way, but also, when setting of a mode corresponding to a displayed key is not allowed, the key is displayed in dotted lines or is shaded, to indicate that the key cannot be operated.

Further, in the illustrated example, details of the user's configuration of the copying operation mode and the present operating state are displayed in the uppermost area of the screen on the display panel 620. On the other hand, in the lowermost area of the screen on the display panel 620, there is displayed an operating state of another function mode, referred to hereinafter, in a single line as briefly as possible. In FIG. 2, it is indicated that the function of Copy B is in operation for output to a printer section 2.

In FIG. 2, reference numerals 601k to 612 designate keys and LED indicators for setting up functions for copying operation and system operation. The keys 601k, 604, 607, 610 are function-switching keys for switching one function to another. These function-switching keys are formed by a translucent key button, and contain an indicator lamp (not shown), such as an LED. When an operating screen is selected by depressing one of the function-switching keys, the lamp in the key is lighted. The lamps within the keys are controlled such that only a lamp within a key corresponding to a selected operating screen is lighted, and the others are extinguished.

Further, the keys have respective green LEDs 603, 606, 609, 612 provided on the right sides thereof. The LEDs 603, 606, 609, 612 indicate operating states of functions of the associated keys by controlled lighting statuses thereof. For example, the LED 606 of the key 604 for Copy B is extinguished during standby of the function of Copy B, and caused to flash during output operation of the same. Similarly, the LED 609 of the key 607 for Fax is caused to flash during communicating operation, printing operation, and reading operation of the function of Fax.

Further, the keys have respective red LEDs 602L 605, 608, 611 provided on the left sides thereof. The LEDs 602L, 605, 608, 611 indicate abnormal operating states of functions of the associated keys by controlled lighting statuses thereof. For example, the LED 605 of the key 604 for Copy 8 Is caused to flash upon occurrence of an abnormality, such as interruption due to absence of sheets, or a sheet jam. In such a case, by depressing the function-switching key 604 for Copy B to switch the operating section 4 to a screen for Copy B, the operating state of the function of Copy B is displayed on the display panel 620, whereby detailed information of the abnormal state can be checked.

These function-switching keys can be depressed anytime, irrespective of the operating states of the functions, to switch the operating section 4 to a desired screen. In the present embodiment, when switching between the function of Copy A and the function of Copy B is allowed, the keys, such as the stop key 615, the start key 614, and the reset key 616, other than the keys within the display panel 620 are operable for the function selected by the function-switching key 601k or 604.

Next, the types of commercially available tab sheet bundles will be described with reference to FIGS. 3A and 3B.

Figure 3A:
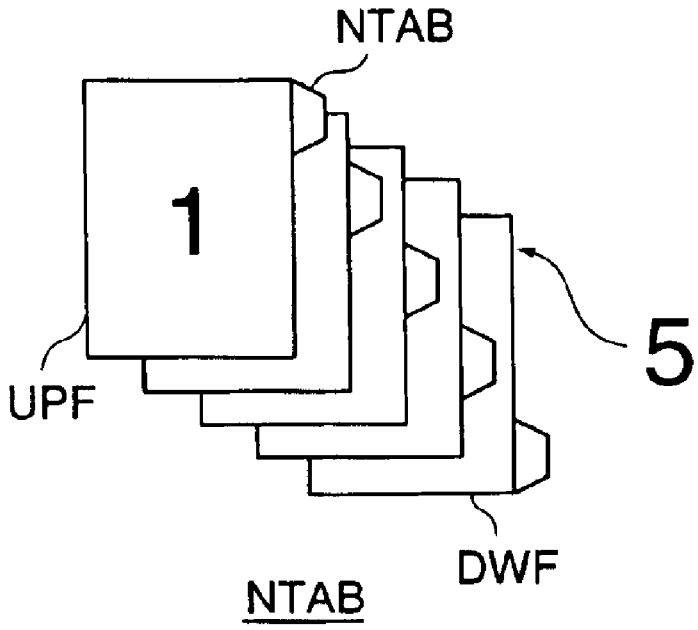
Figure 3B:
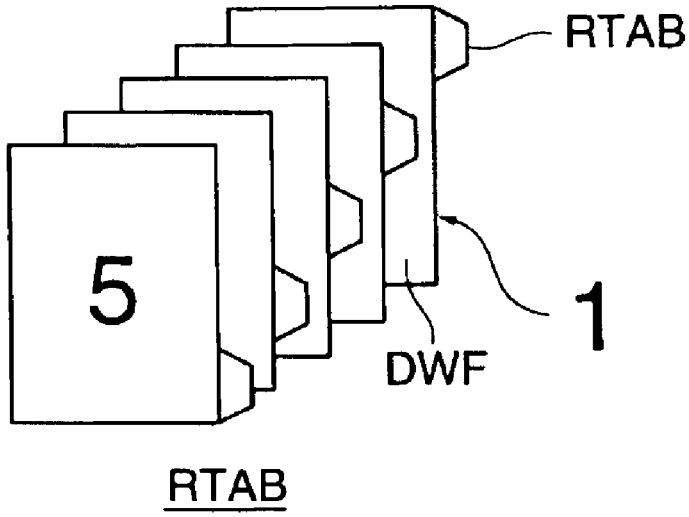

FIGS. 3A and 3B are views showing types of tab sheet bundles applicable to the image forming apparatus 1. FIG. 3A shows a normal tab sheet bundle, while FIG. 3B shows a reverse tab sheet bundle. In the following, a 5-tab sheet bundle having five tabs on a bundle of five sheets, will be described as an example of the commercially available tab sheet bundle.

As shown in FIGS. 3A and 3B, one 5-tab sheet bundle is composed of five sheets. Normally, a tab sheet bundle, of which the uppermost sheet UPF has a tab NTAB at an uppermost right-side portion thereof, as shown in FIG. 3A, (i.e. a tab sheet bundle whose sheets are arranged in normal page order) is called a normal tab sheet bundle, and a tab sheet bundle, of which the lowermost sheet DWF has a tab RTAB at an uppermost right-side portion thereof, as shown in FIG. 3B, (i.e. a tab sheet bundle whose sheets are arranged in reverse page order) is called a reverse tab sheet bundle. The commercially available tab sheet bundles are mainly of these two types. The first page of the normal tab sheet bundle has a tab at an uppermost location of a right-hand side thereof, and the following pages each have a tab formed at a lower location than the location of a tab on the immediately preceding page. On the other hand, the last page of the reverse tab sheet bundle has a tab at an uppermost location of a right-hand side thereof, and the preceding pages each have a tab formed at a lower location than the location of a tab on the immediately following page.

FIGS. 4A to 7B are views useful in explaining changes in the page order of a tab sheet bundle in a case where the tab sheets of the tab sheet bundle are conveyed in the image forming apparatus 1. The same component parts and elements as appear in FIGS. 1, 3A, and 3B are designated by the same reference numerals. Circled numbers 1 to 5 in FIGS. 4B, 5B, 6B, and 7B designate positions in a conveyance sequence (conveyance sequence numbers) assigned to respective tab sheets.

Figure 4A:
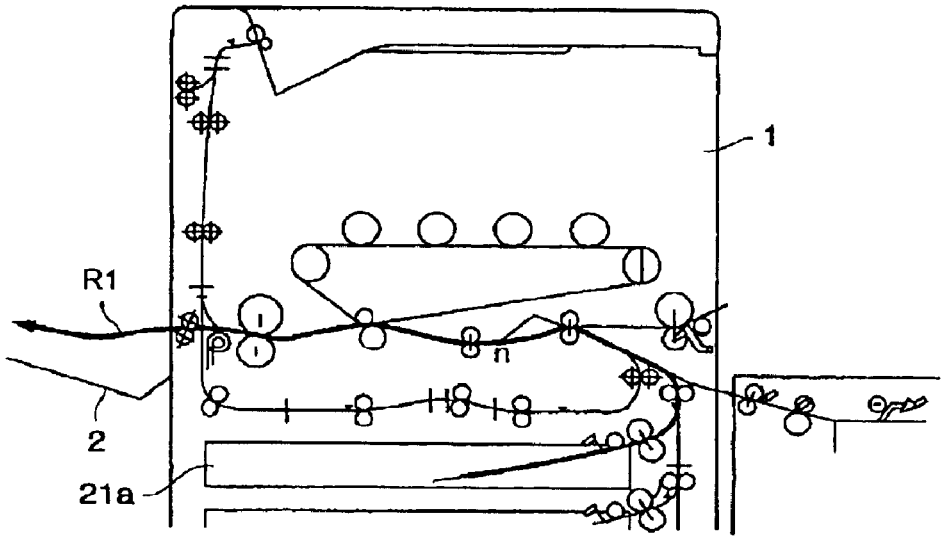

Next, changes in the page order of a tab sheet bundle in a case where the tab sheets thereof are conveyed from the cassette 21*a* to the face-up tray 2 will be explained with reference to FIGS. 4A and 4B.

Figure 4B:
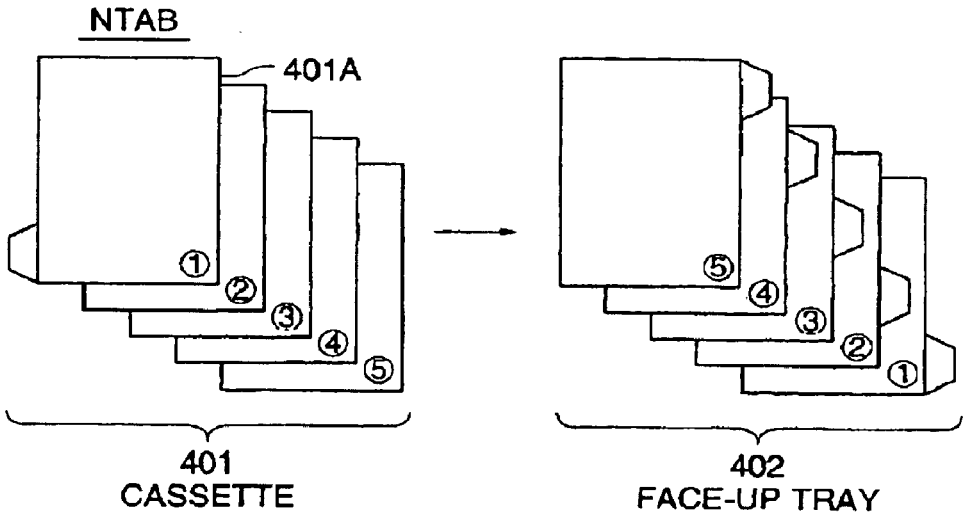

In FIG. 4B, reference numeral 401 designates a tab sheet bundle set in the cassette 21*a*, as viewed from the top of the apparatus, in exploded form. The tab sheet bundle 401 is a normal tab sheet bundle. The sheets of the tab sheet bundle 401 are sequentially fed in the order of the conveyance sequence numbers, with a side 401A opposite to a side formed with a tab being directed forward, and conveyed via a path R1 in the image forming apparatus 1.

An image is formed on the lower surface (after inversion during conveyance) of each tab sheet, i.e. a surface thereof facing downward when the tab sheet bundle 401 is in the cassette 21*a*, and therefore the page order is reversed. However, in the present case, the tab sheet bundle 401 is discharged onto the face-up tray 2, so that the tab sheets thereof are stacked face-up therein, in a page order further reverse to the reversed page order, i.e. the original page order of the tab sheet bundle 401. Therefore, when a normal tab sheet bundle is used as the tab sheet bundle 401, the tab sheet bundle is discharged to the face-up tray 2 such that the sheets thereof are stacked in the normal page order as shown by a tab sheet bundle 402.

Figure 5A:
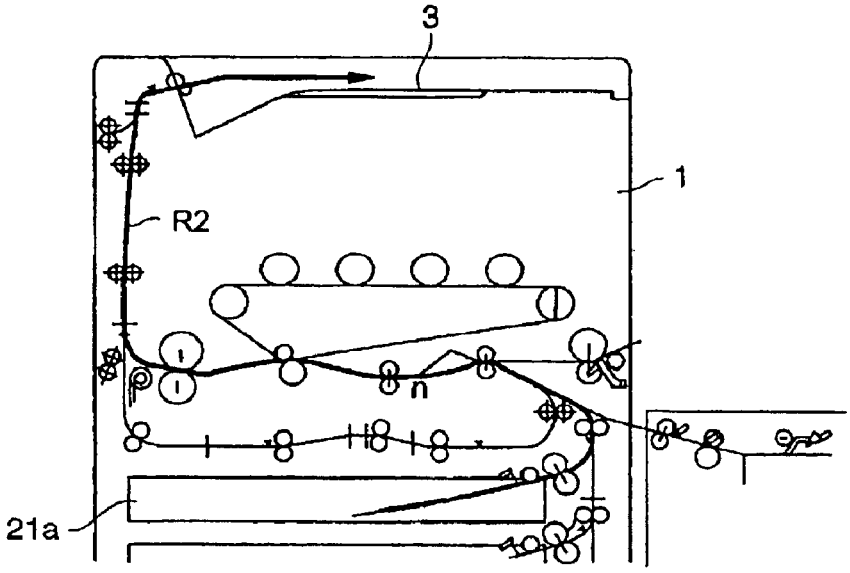

Next, changes in the page order of a tab sheet bundle in a case where the tab sheets thereof are conveyed from the cassette 21*a* to the face-down tray 3 will be explained with reference to FIGS. 5A and 5B.

Figure 5B:
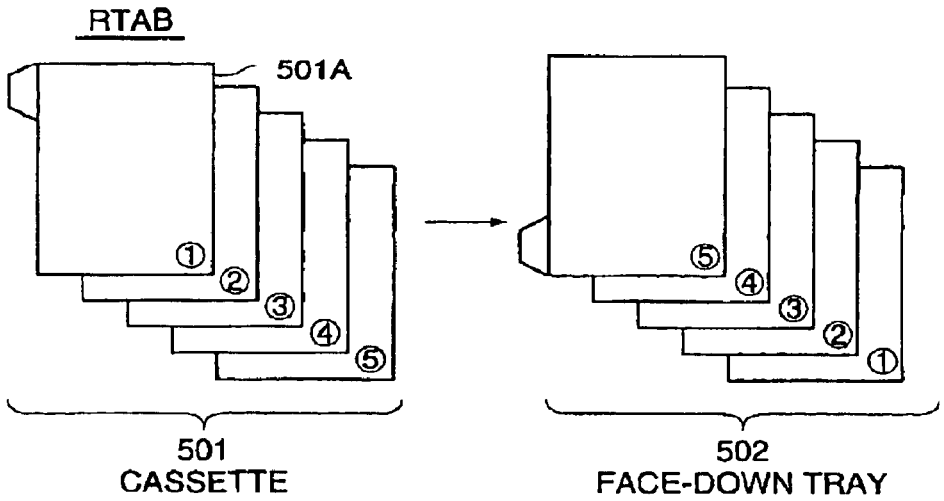

In FIG. 5B, reference numeral 501 designates a tab sheet bundle set in the cassette 21*a*, as viewed from the top of the apparatus, in exploded form. The tab sheet bundle 501 is a reverse tab sheet bundle. The sheets of the tab sheet bundle 501 are sequentially fed in the order of the conveyance sequence numbers, with a side 501A opposite to a side formed with a tab being directed forward, and conveyed via a path R2 in the image forming apparatus 1.

An image is formed on the lower surface of each tab sheet, i.e. a surface thereof facing upward when the tab sheet bundle 501 is in the cassette 21*a*, and therefore the page order (reverse page order) is reversed. In the present case, however, the tab sheet bundle is discharged onto the face-down tray 3, so that the tab sheets thereof are stacked face-down therein without changing the reversed page order. Therefore, when a reverse tab sheet bundle is used as the tab sheet bundle 501, the tab sheet bundle is discharged to the face-down tray 3 such that the tab sheets thereof are stacked in the normal page order as shown by a tab sheet bundle 502. In other words, assuming that a normal tab sheet bundle is set in the cassette 21*a*, the tab sheets reversed in page order during image formation are discharged onto the face-down tray 3 without changing the reversed page order, and hence the obtained output of the tab sheet bundle has the reverse page order.

Figure 6A:
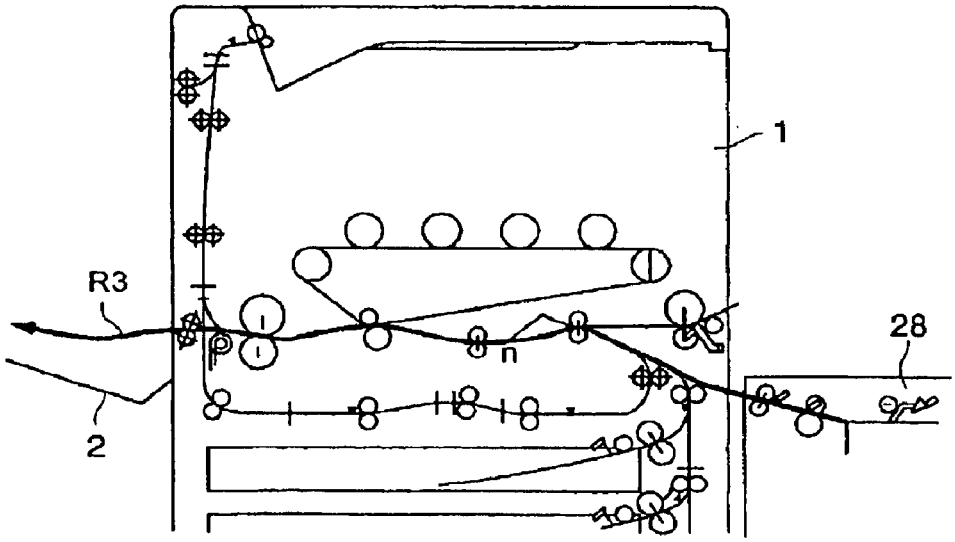

Next, changes in the page order of a tab sheet bundle in a case where the tab sheets thereof are conveyed from the deck 28 to the face-up tray 2 will be described with reference to FIGS. 6A and 6B.

Figure 6B:
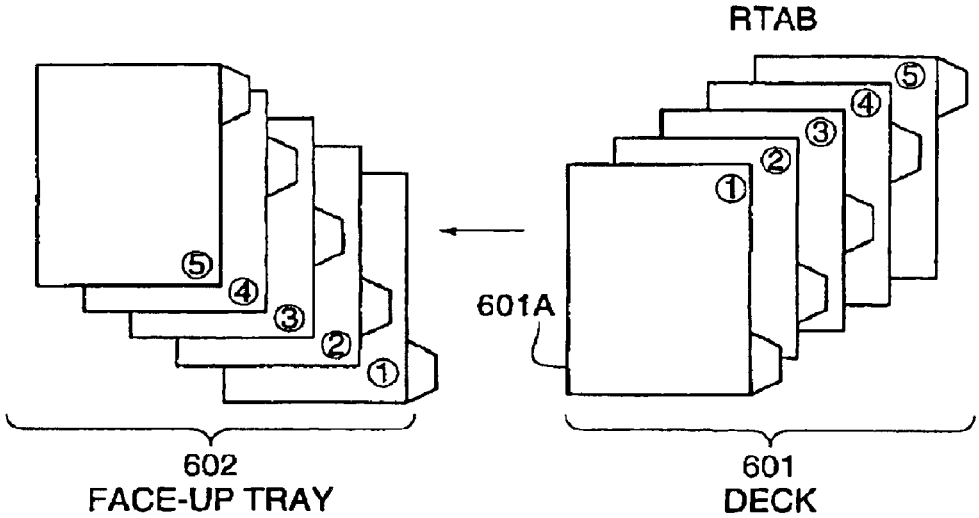

In FIG. 6B, reference numeral 601 designates a tab sheet bundle set in the deck 28, as viewed from the top of the apparatus, in exploded form. The tab sheet bundle 601 is a reverse tab sheet bundle. The sheets of the tab sheet bundle 601 are fed with a side 601A opposite to a side formed with a tab being directed forward, and conveyed via a path R3 through the image forming apparatus 1.

An image is formed on the upper surface of each tab sheet, i.e. a surface thereof facing upward when the tab sheet bundle 601 is in the deck 28, and hence the page order is not changed. However, the tab sheet bundle is discharged onto the face-up tray 2, so that the tab sheets thereof are stacked face-up therein in an order reverse to the original reverse page order of the reverse tab sheet bundle, i.e. in the normal page order. Therefore, when a reverse tab sheet bundle is used as the tab sheet bundle 601, the tab sheet bundle is discharged onto the face-up tray 2 such that tab sheets thereof are stacked in the normal page order as a tab sheet bundle 602. In other words, assuming that a normal tab sheet bundle is set in the deck 28, the tab sheets are discharged onto the face-up tray 2, reversing the page order of the normal tab sheet bundle, and hence the obtained output of the tab sheet bundle has the reverse page order.

Figure 7A:
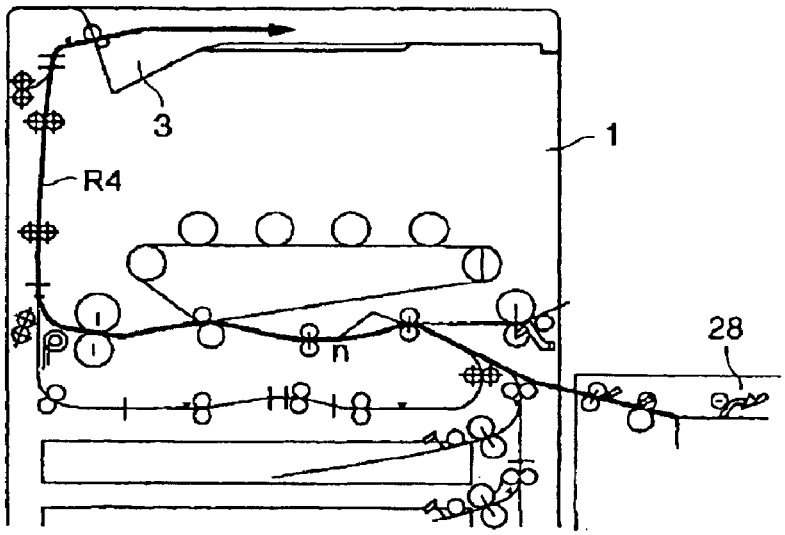

Next, changes in the page order of a tab sheet bundle in a case where the tab sheets thereof are conveyed from the deck 28 to the face-down tray 3 will be described with reference to FIGS. 7A and 7B.

Figure 7B:
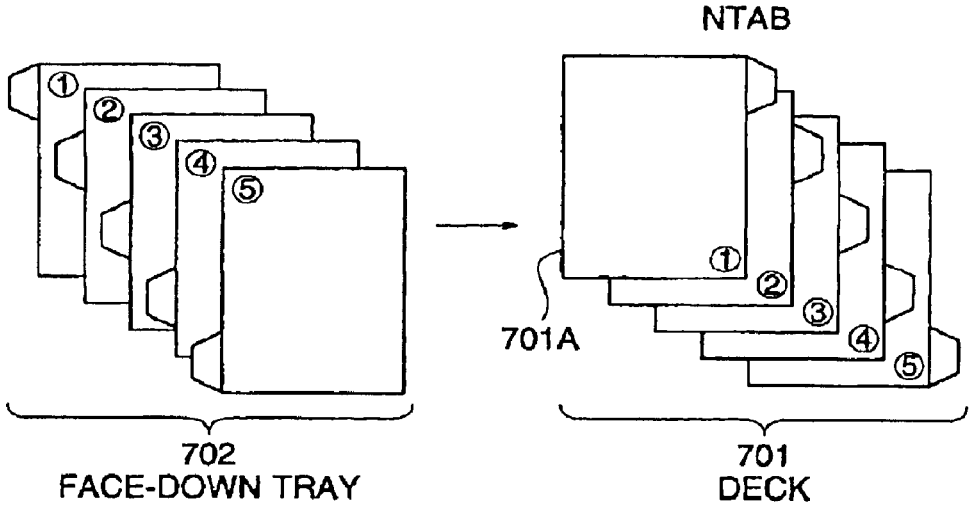

In FIG. 7B, reference numeral 701 designates a tab sheet bundle set in the deck 28, as viewed from the top of the apparatus, in exploded form. The tab sheet bundle 701 is a normal tab sheet bundle. The sheets of the tab sheet bundle 701 are fed with a side 701A opposite to a side formed with a tab being directed forward, and conveyed via a path R4 in the image forming apparatus 1.

An image is formed on the upper surface of each tab sheet, i.e. a surface thereof facing upward when the tab sheet bundle 701 is in the deck 28, and therefore the page order is not changed. Further, the tab sheet bundle 701 is discharged onto the face-down tray 3, so that the page order is not changed, either. Therefore, when a normal tab sheet bundle is used as the tab sheet bundle 701, the tab sheet bundle is discharged in the normal page order as shown by a tab sheet bundle 702.

Proper combinations of feed tray type, discharge tray type, page output order, and tab sheet type, which enable the image forming apparatus 1 to output tab sheets in the normal page order, as described above with reference to FIGS. 3A to 7B, can be summarized by a table shown in FIG. 8.

As shown in FIG. 8, when the face-down tray is used as a discharge tray, the page order of tab sheets fed from any of the cassettes 21*a* to 21*d* is reversed, and therefore a reverse tab sheet bundle is set in these cassettes. On the other hand, the page order of tab sheets fed from the deck 28 or the manual feed tray 27 is not reversed, and therefore a normal tab sheet bundle is set in the deck 28 and the manual feed tray 27.

On the other hand, when the face-up tray is used as a discharge tray, the page order of tab sheets fed from the cassettes 21*a* to 21*d* is not changed, and therefore a normal tab sheet bundle is set in these cassettes. On the other hand, the page order of tab sheets fed from the deck 28 or the manual feed tray 27 is reversed, and therefore, a reverse tab sheet bundle is set in the deck 28 or the manual feed tray 27.

The proper combinations of feed tray type, discharge tray type, page output order, and tab sheet type, as shown in FIG. 8, which make it possible to obtain valid images, may be stored as a tab sheet mode management table, e.g. in a nonvolatile memory, not shown, such as a hard disk and an EEPROM, provided within the controller section CONT, whereby the CPU in the controller section CONT may automatically select a feed tray according to the tab sheet mode management table. This makes it possible to adapt to a case where a feed tray, a sheet discharge tray, or the like is added as an option, not by changing a program executed by the apparatus, but simply by changing the tab sheet mode management table, which contributes to marked enhancement in the function extensibility of the apparatus.

Further, although in the present embodiment, the sheets of a tab sheet bundle set in any of the cassettes 21*a* to 21*d*, the deck 28, and the manual feed tray 27 are fed sequentially starting with the uppermost sheet, this is not limitative, but the sheets of the tab sheet bundle may be fed sequentially starting with the lowermost sheet, for example. In this case, the proper combinations of feed tray type, discharge tray type, page output order, and tab sheet type, which makes it possible to obtain valid images, is different from those shown in FIG. 8 only in that the page output orders are reversed.

Next, a tab sheet mode process according to the present embodiment will be described with reference to a flowchart shown in FIG. 9.

Figure 9:
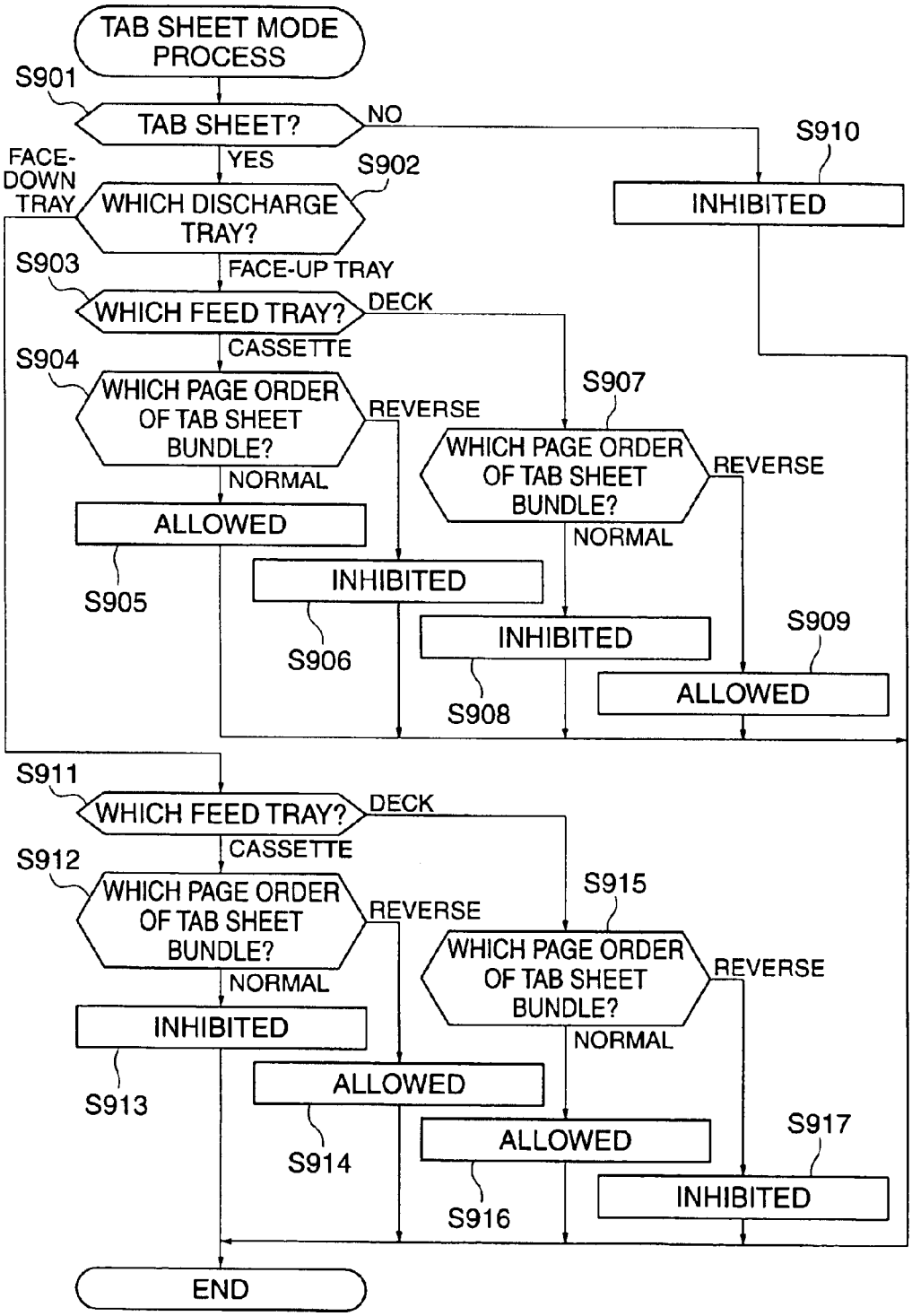
FIG. 9 is a flowchart showing a tab sheet mode process executed by the image forming apparatus shown in FIG. 1.

FIG. 9 is a flowchart showing a tab sheet mode process executed by the image forming apparatus 1 shown in FIG. 1. The present process is executed by the CPU based on the program stored in the ROM of the controller section CONT appearing in FIG. 1. This process is called for execution whenever a predetermined operation is made by the user via the operating section 4. Alternatively, the present process may be called for execution only upon selection of a feed tray or a discharge tray, or upon setting of a tab sheet type of tab sheets.

When the process is started, first, it is determined in a step S901 whether or not the apparatus 1 is in a tab sheet mode in which tab sheets are fed to have images formed thereon and are discharged to a designated discharge tray. If it is determined that the apparatus 1 is not in the tab sheet mode, the process proceeds to a step S910, wherein operations in the tab sheet mode are inhibited, followed by terminating the present process.

On the other hand, if it is determined in the step S901 that the apparatus 1 is in the tab sheet mode, the process proceeds to a step S902, wherein it is determined which discharge tray has been selected. If it is determined that the face-down tray 3 has been selected, the process proceeds to a step S911, whereas if it is determined that the face-up tray 2 has been selected, the process proceeds to a step S903.

In the step S903, it is checked which feed tray contains tab sheets, and if it is determined that the deck 28 or the manual feed tray 27 contains tab sheets, the process proceeds to a step S907, whereas if it is determined that any of the cassettes (21*a* to 21*d*) contains tab sheets, the process proceeds to a step S904.

In the step S904, the designated tab sheet page order (type) is checked, and if it is determined that the designated tab sheet page order (type) is the normal tab sheet, the process proceeds to a step S905, wherein operations in the tab sheet mode are allowed, followed by terminating the present process, whereas if it is determined that the designated tab sheet page order (type) is the reverse tab sheet, the process proceeds to a step S906, wherein operations in the tab sheet mode are inhibited, followed by terminating the present process. In the step S906, a message saying "Please set a normal tab sheet bundle." may be displayed on the display panel 620.

On the other hand, in the step S907, the designated tab sheet page order (type) is checked, and if it is determined that the designated tab sheet page order (type) is the normal tab sheet, the process proceeds to a step S908, wherein operations in the tab sheet mode are inhibited, followed by terminating the present process, whereas if it is determined that the designated tab sheet page order (type) is the reverse tab sheet, the process proceeds to a S909, wherein operations in the tab sheet mode are allowed, followed by terminating the present process. In the step S908, a message saying "Please set a reverse tab sheet bundle." may be displayed on the display panel 620.

In the step S911 following the step S902, it is checked which feed tray contains tab sheets, and if it is determined that the deck 28 or the manual feed tray 27 contains tab sheets, the process proceeds to a step S915, whereas if it is determined that any of the cassettes (21*a* to 21*d*) contains tab sheets, the process proceeds to a step S912.

Then, in a step S912, the designated tab sheet page order (type) is checked, and if it is determined that the designated tab sheet page order (type) is the normal tab sheet, the process proceeds to a step S913, wherein operations in the tab sheet mode are inhibited, followed by terminating the present process, whereas if it is determined the designated tab sheet page order (type) is the reverse tab sheet, the process proceeds to a S914, wherein operations in the tab sheet mode are allowed, followed by terminating the present process. In the step S913, a message saying "Please set a reverse tab sheet bundle." may be displayed on the display panel 620.

On the other hand, in thehe designated tab sheet page order (type) is checked, and if it is determined that the designated tab sheet page order (type) is the normal tab sheet, the process proceeds to a step S916, wherein operations in the tab sheet mode are allowed, followed by terminating the present process, whereas if it is determined that the designated tab sheet page order (type) is the reverse tab sheet, the process proceeds to a S917, wherein operations in the tab sheet mode are inhibited, followed by terminating the present process. In the step S917, a message saying "Please set a normal tab sheet bundle." may be displayed on the display panel 620.

Figure 10A:
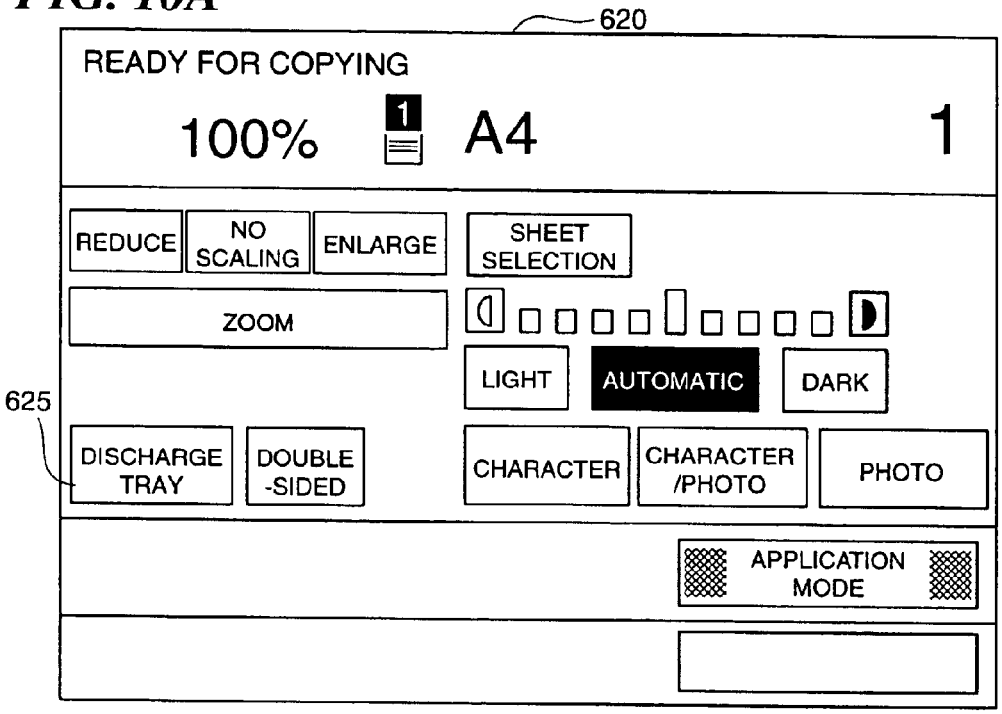
Figure 10B:
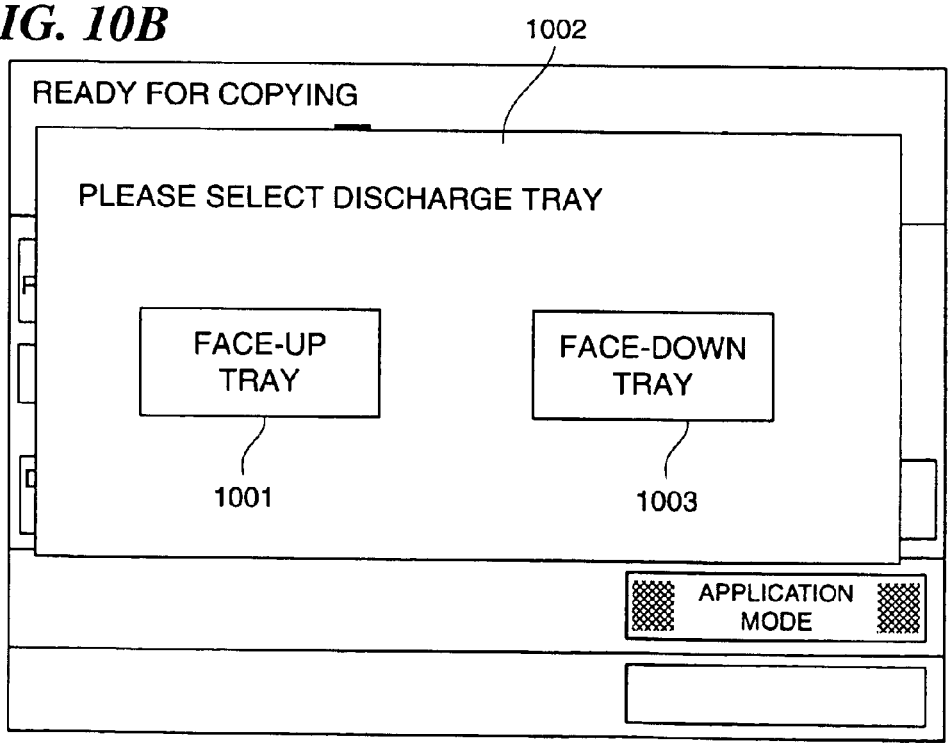

FIGS. 10A and 10B are views showing operating screens displayed on the display panel 620 in FIG. 2. FIG. 10A shows an operating screen in a standby state, while FIG. 10B shows an operating screen for selecting a discharge tray. In the following, a description will be given of a method of selecting a discharge tray, according to the present embodiment.

FIG. 10A shows a screen (default or home screen) displayed on the display panel 620 of the operating section 4 in a copying-ready state (standby state) of the image forming apparatus 1. When the discharge tray selection key 625 is depressed in this screen, the apparatus 1 is switched to a discharge tray selectable state in which a discharge tray selection screen 1002 shown in FIG. 10B is displayed.

Further, when the discharge tray selection screen 1002 is displayed, if a face-up tray key 1001 appearing therein is depressed, sheets fed after the start of the operation of the apparatus 1 are discharged onto the face-up tray 2.

On the other hand, when the discharge tray selection screen 1002 is displayed, if a face-down tray key 1003 appearing therein is depressed, sheets fed after the start of the operation of the apparatus 1 are discharged onto the face-down tray 3.

Next, a method of designating a page order of a tab sheet bundle according to the present embodiment, will be described with reference to FIGS. 11 to 15.

FIGS. 11 to 15 are diagrams showing operating screens displayed on the display panel 620 shown in FIG. 2.

Figure 11:
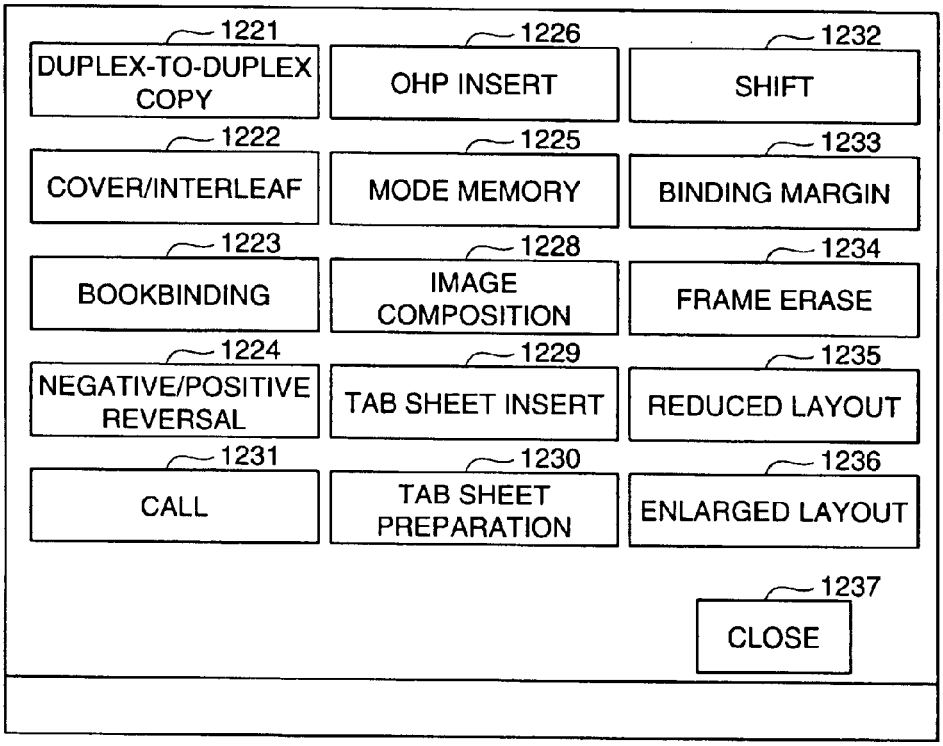
FIG. 11 is a diagram showing an operating screen displayed on the display panel shown in FIG. 2.

An application mode list screen shown in FIG. 11 is displayed when the application mode key 626 on the display panel 620 shown in FIG. 2 in the standby state is depressed by the user. In the application mode list screen, there are displayed icons for setting respective copy modes.

In FIG. 11, a "duplex-to-duplex copy" key 1221 is for setting a mode in which an original is spread in two pages, and the two pages of original are read as two originals.

A "cover/interleaf" key 1222 is for setting a mode in which a cover sheet, a back cover sheet, or an interleaved sheet for separation of sheets is selected as a sheet to be output, set in a feed tray, and then sheets with the cover sheet, back sheet or interleaved sheet are output as one copy.

A "bookbinding mode" key 1223 is for setting a mode in which after originals have been copied on sheets to be output, the sheets to be output are folded at a center thereof and output like a double-page spread of a book.

A "negative/positive reversal" key 1224 is for setting a mode in which a white portion of an image of an original is copied in black, and a black portion in white.

A "mode memory" key 1225 is for storing a combination of modes set by operating a plurality of keys.

An "OHP insert" key 1226 is for setting an OHP insertion mode in which OHP sheets are set e.g. in the manual feed tray 27, and while alternately feeding the OHP sheets set in the manual feed tray 27 and plain sheets, printing is performed on the OHP sheets.

An "image composition" key 1228 is for setting a mode in which a background image registered in advance is output with an image for printing being superimposed thereon.

A "tab sheet insert" key 1229 is for setting a mode for inserting a tab sheet as a separation sheet between print sheets.

A "tab sheet preparation" key 1230 is for setting a mode for feeding a tab sheet and printing on a tab of the tab sheet.

A "call" key 1231 is for executing a mode for calling settings made in the immediately preceding copying operation.

A "shift" key 1232 is for setting a mode for shifting the position of an image of an original on a sheet to which the original image is to be output.

A "binding margin" key 1233 is for setting a mode for shifting the position of an image of an original on a sheet to which the image is to be output, so as to form a binding margin.

A "frame erase" key 1234 is for setting a mode for erasing an outer frame of an image of an original, or erasing an image of an outer frame on a sheet before printing.

A "reduced layout" key 1235 is for setting a mode for laying out images of a plurality of originals in a single sheet on a reduced scale and printing them on a sheet.

An "enlarged layout" key 1236 is for setting a mode for splitting an original image of one page into a plurality of images, and printing the split images on an enlarged scale on separate sheets.

A "close" key 1237 is for closing a sub-window for setting the application mode and returning the screen to the default screen shown in FIG. 10A.

When the user depresses the tab sheet insert key 1229 or the tab sheet preparation key 1230 on the screen described with reference to FIG. 11, the screen on the display panel 620 is switched to a tab sheet-setting screen shown in FIG. 12.

Figure 12:
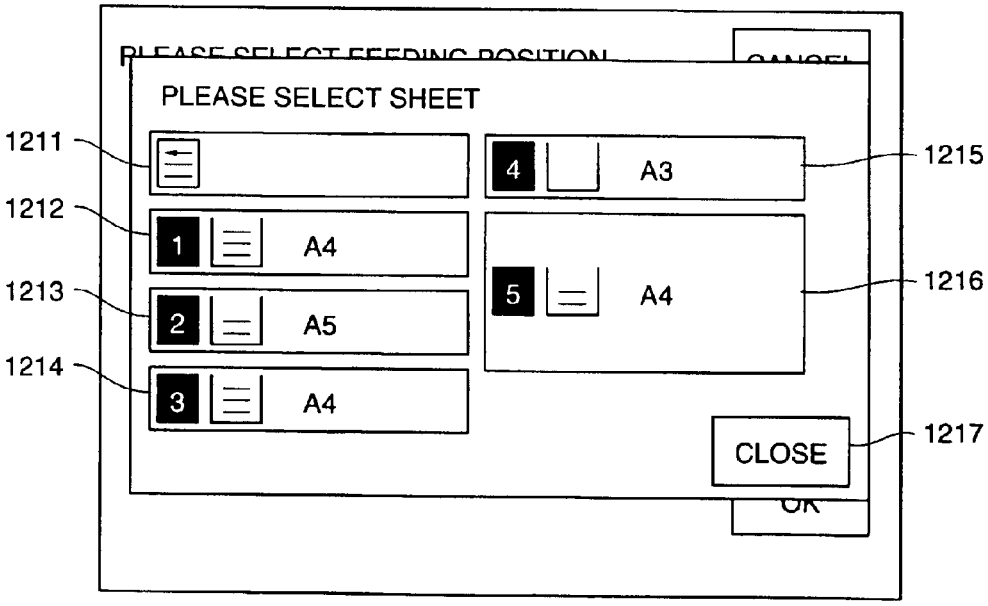
FIG. 12 is a diagram showing an operating screen displayed on the display panel shown in FIG. 2.

On the screen shown in FIG. 12, the user can select any of the cassettes, the manual feed tray, and the deck, as a cassette or a tray having tab sheets set therein.

In FIG. 12, reference numeral 1211 designates a manual feed key, which is depressed to designate the manual feed tray 27 as a tray having tab sheets set therein. Reference numeral 1212 designates a cassette 1 key, which is depressed to designate the cassette 21*a* as a cassette having tab sheets set therein.

Reference numeral 1213 designates a cassette 2 key, which is depressed to designate the cassette 21*b* as a cassette having tab sheets set therein. Reference numeral 1214 designates a cassette 3 key, which is depressed to designate the cassette 21*c* as a cassette having tab sheets set therein.

Reference numeral 1215 designates a cassette 4 key, which is depressed to designate the cassette 21*d* as a cassette having tab sheets set therein. Reference numeral 1216 designates a deck key, which is depressed to designate the deck 28 as a tray having tab sheets set therein.

Reference numeral 1217 designates a close key, which is depressed to interrupt an operation for selecting a tray having tab sheets set therein. When the user depresses any of the above mentioned keys, the screen on the display panel 620 is switched to a tab count-setting screen shown in FIG. 13.

In the illustrated example of the present embodiment, it is assumed that the cassette 3 key 1214 is depressed on the screen in FIG. 12.

Figure 13:
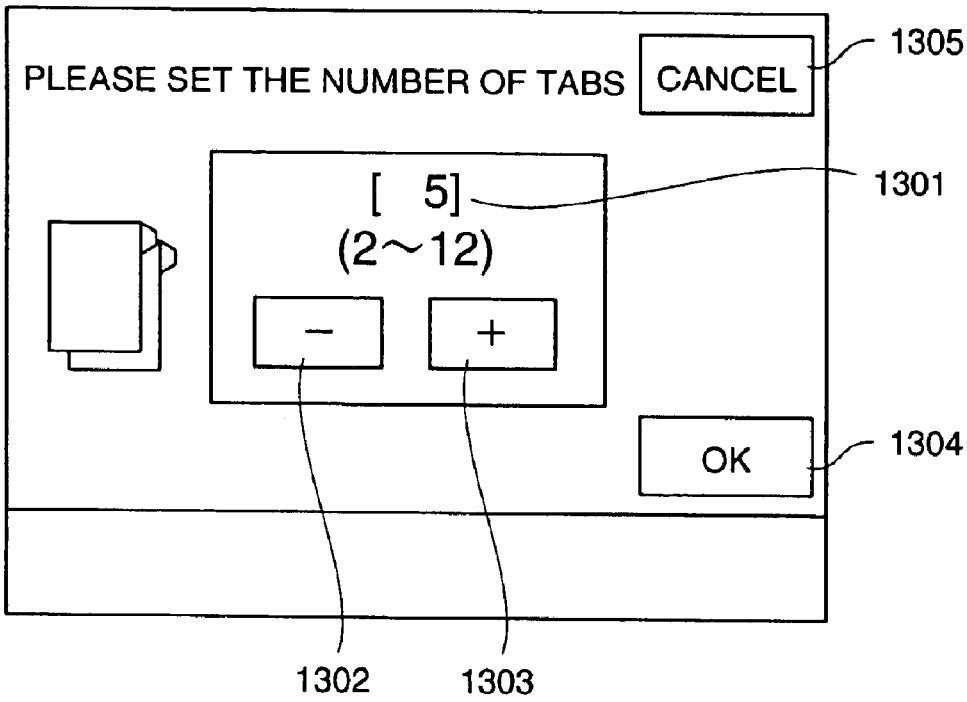
FIG. 13 is a diagram showing an operating screen displayed on the display panel shown in FIG. 2.

In the tab count-setting screen shown in FIG. 13, the user enters a tab division number for a tab sheet bundle. Although a 5-tab sheet bundle formed of a set of five tab sheets is generally used, the tab division number can be set for tab sheet bundles ranging from a 2-tab sheet bundle formed of a set of two tab sheets to a 12-tab sheet bundle formed of a set of twelve tab sheets. The term "tab division number" means the number of tab sheets forming one set.

In FIG. 13, 1301 designates a field in which the tab division number is being entered to be set. The tab division number can be increased and decreased by using a "plus" key 1303 and a "minus" key 1302.

An "OK" key 1304 is for setting an entered tab division number. A "cancel" key 1305 is for returning to the application mode screen described with reference to FIG. 11 from the sub-window for entering the tab division number (the tab count-setting screen shown in FIG. 13), without setting the number of tab divisions.

Figure 14:
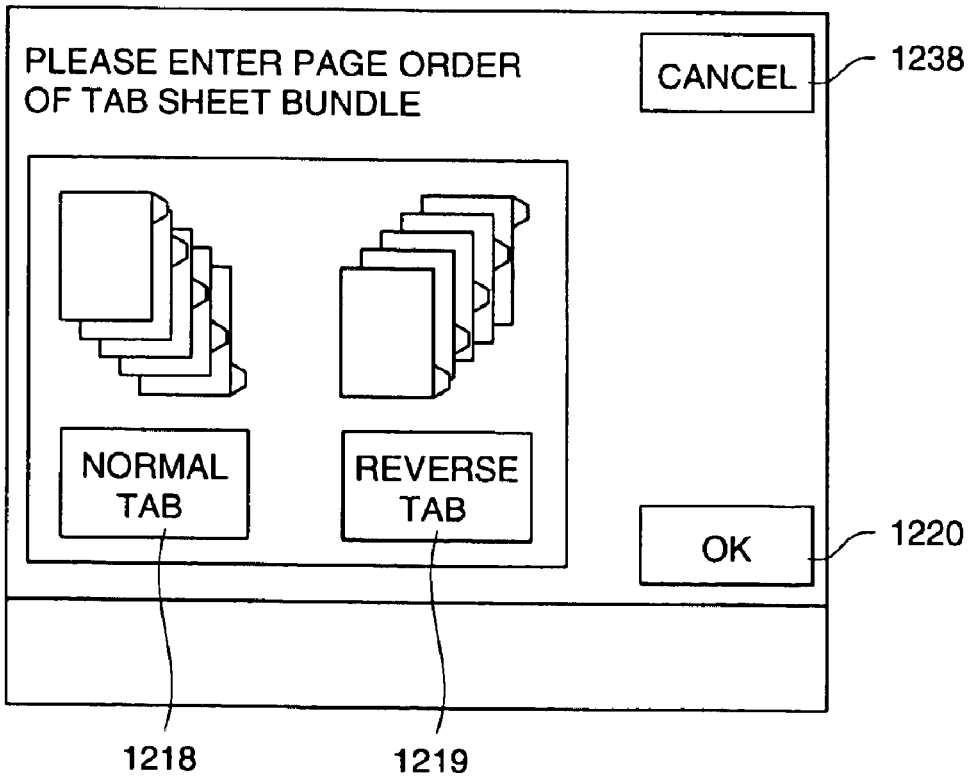
FIG. 14 is a diagram showing an operating screen displayed on the display panel shown in FIG. 2.

When the number of tabs is entered on the screen shown in FIG. 13, and thereafter, the OK key 1304 is depressed, a screen shown in FIG. 14 for designating the page order of a tab sheet bundle is displayed on the display panel 620.

In the screen shown in FIG. 14, the page order of a tab sheet bundle to be set is designated.

In FIG. 14, when the tab sheet bundle to be set is a normal tab sheet bundle, a normal tab key 1218 is depressed, while when the tab sheet bundle is a reverse tab sheet bundle, a reverse tab key 1219 is depressed.

Figure 15:
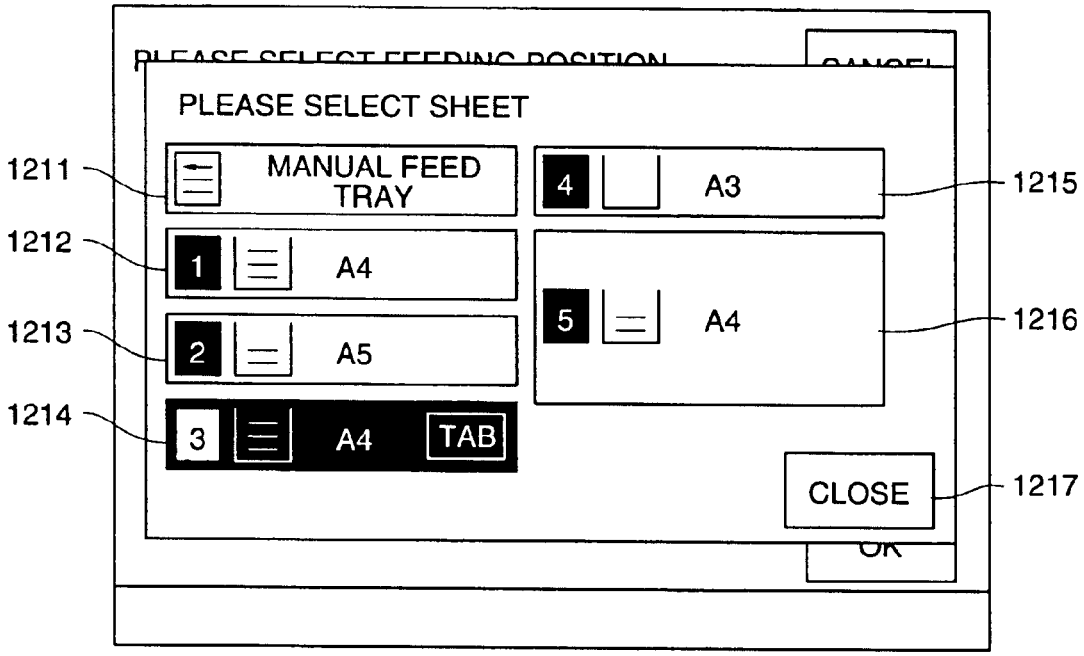
FIG. 15 is a diagram showing an operating screen displayed on the display panel shown in FIG. 2.

When an OK key 1220 is depressed after depression of the normal tab key 1218 or the reverse tab key 1219 according to the page order of the tab sheet bundle to be set, the setting of the tab sheet type is confirmed, and a screen shown in FIG. 15 is displayed.

It is assumed that in the present embodiment, the tab sheet setting information designated as described above with reference to FIGS. 11 to 14 is stored in the RAM of the controller section CONT appearing in FIG. 1, as sheet management information. The sheet management information may be stored not only in a volatile memory medium, such as a RAM, but also in a hard disk, an EEPROM, or the like, for example.

As shown in FIGS. 11 to 14, a tab sheet preparation mode or a tab sheet insert mode is set via the operating section 4, and for any of the cassette 21*a* to 21*d*, the manual feed tray 27, and the deck 28, as feed trays, a combination of a material of a recording medium to be fed and a page order is designated, and stored as the sheet management information in the RAM of the controller section CONT appearing in FIG. 1. Therefore, it goes without saying that the user can set the combination, as desired.

As a result, the RAM stores information as to whether sheets set in the feed trays (the cassettes 21*a* to 21*d*, the manual feed tray 27, the deck 28) are tab sheets, and if the sheets on a feed tray are tab sheets, whether the page order of tab sheets is a normal one or a reverse one. More specifically, in the illustrated example, the RAM stores information that sheets of plain paper are set in the cassettes 21*a* and 21*b*, a normal tab sheet bundle in the cassette 21*c*, a reverse tab sheet bundle in the cassette 21*d*, a normal sheet bundle in the manual feed tray 27, and a normal tab sheet bundle in the deck 28.

When a cancel key 1238 is depressed on the screen shown in FIG. 14, the screen is switched to the screen shown in FIG. 13, for entering the tab division number.

A sheet selection screen displayed as shown in FIG. 15 is the same screen as shown in FIG. 12, but in the illustrated example, as a result of the designation of the cassette 21*c* as a cassette having tab sheets set therein, the cassette 3 key 1214 is displayed in reverse video or highlighted, with an indication "tab" added thereto.

Now, if the close key 1217 is depressed, the screen returns to the default screen shown in FIG. 10A. On the other hand, if any of the keys 1211 to 1216 is depressed, the screen shown in FIG. 15 continues to be displayed, whereby it is possible to continue configuring the setting of a tab sheet bundle for another feed tray.

In the above described embodiment, after a discharge tray and a feed tray (including the page order of tab sheets) are all set, control is provided as to whether image formation is allowed or inhibited. As a variation of the present embodiment, when a discharge tray has been already set, control may be provided such that referring to the combinations (sheet management table) shown in FIG. 8, a feed tray unsuitable due to the page order of tab sheets is inhibited from being selected via the display panel (touch panel) 620 of the operating section. Further, when a feed tray has been already set, control may be provided such that a discharge tray unsuitable due to the page order of tab sheets is inhibited from being selected via the display panel (touch panel) 620 of the operating section. The following is a description given of the variation of the present embodiment.

Figure 16:
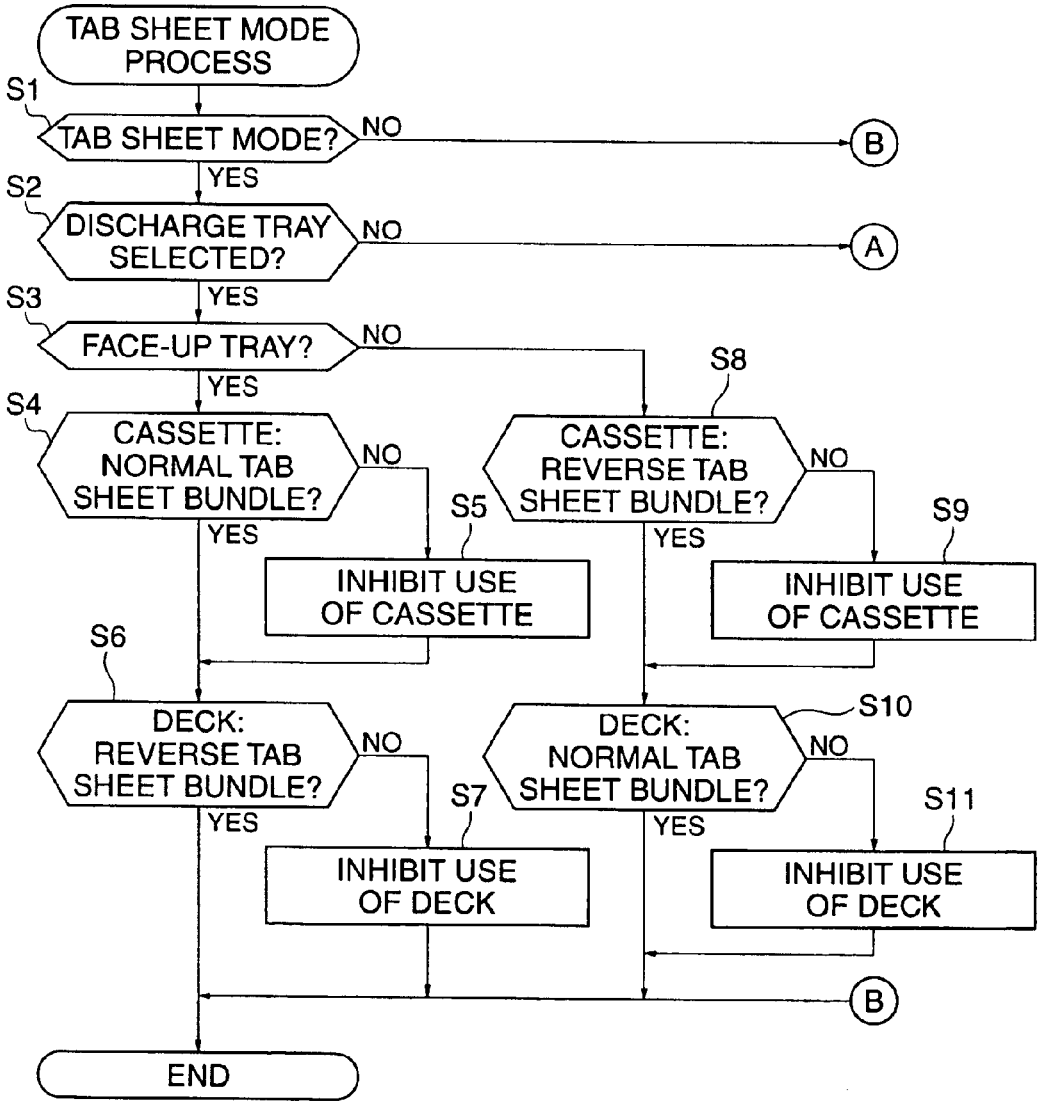
FIG. 16 is a flowchart showing a variation of the tab sheet mode process executed by the image forming apparatus shown in FIG. 1.
Figure 17:
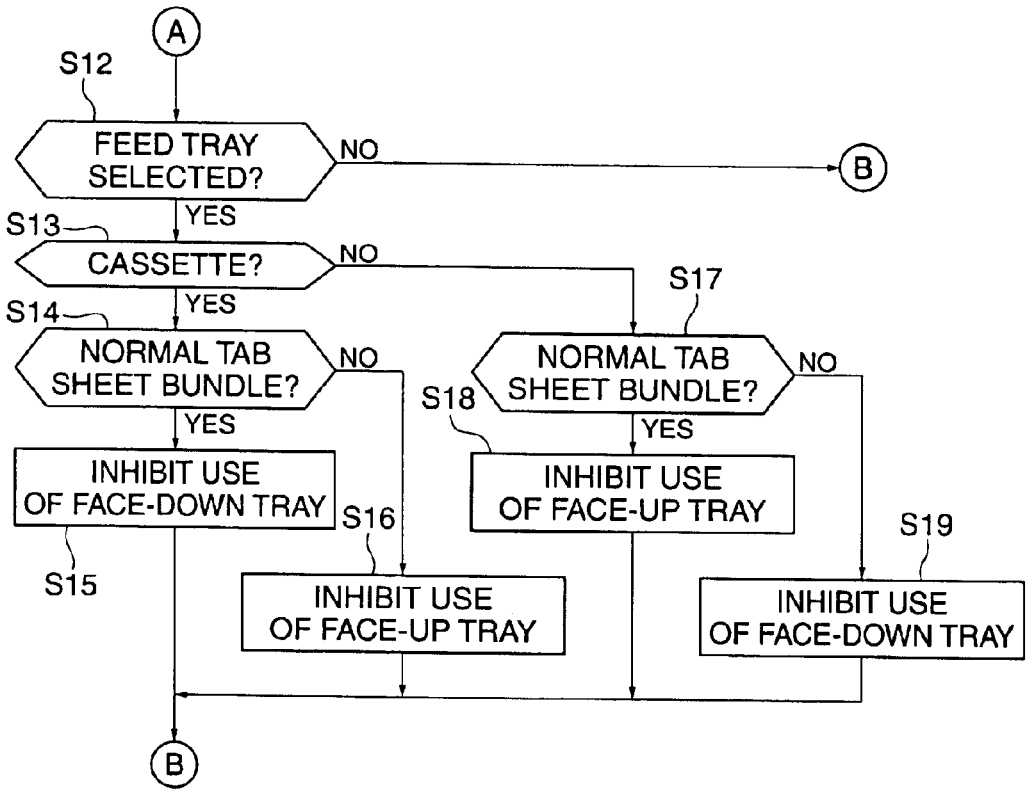
FIG. 17 is a continued part of the flowchart shown in FIG. 16.

FIG. 16 is a flowchart showing a variation of the tab sheet mode process executed by the image forming apparatus 1 shown in FIG. 1, and FIG. 17 is a continued part of the flowchart. The present process is executed by the CPU based on the program stored in the ROM of the controller section CONT appearing in FIG. 1. This process is called for execution whenever a predetermined operation is made by the user via the operating section 4. Further, the present process may be called for execution upon selection of a feed tray or a discharge tray.

When the process is started, first, it is determined in a step S1 whether or not the apparatus 1 is in the tab sheet mode. If it is determined that the apparatus 1 is not in the tab sheet mode, the present process is immediately terminated.

On the other hand, if it is determined in the step S1 that the apparatus 1 is in the tab sheet mode, the process proceeds to a step S2, wherein it is determined whether or not a discharge tray has been selected. If it is determined that the discharge tray has not been selected, the process proceeds to a step S12 in FIG. 17.

On the other hand, if it is determined in the step S2 that a discharge tray has been selected, it is determined in a step S3 whether or not the selected discharge tray is the face-up tray 2. If it is determined that the selected discharge tray is the face-up tray 2, it is determined in a step S4 whether or not a cassette 21*a* contains a normal tab sheet bundle. If the cassette 21*a* contains a normal tab sheet bundle, the process proceeds to a step S6, whereas if the cassette 21*a* does not contain a normal tab sheet bundle, the process proceeds to a step S5, wherein the cassette 21*a* is set to be unselectable (that is, the cassette 1 key 1212 is displayed in a non-selectable state in the screen shown in FIG. 15). The steps S4 and S5 are also repeatedly executed for the cassettes 21*b* to 21*d*.

Then, in the step S6, it is determined whether or not the deck 28 contains a reverse tab sheet bundle, and if the deck 28 contains a reverse tab sheet bundle, the present process is immediately terminated. On the other hand, if the deck 28 does not contain a reverse tab sheet bundle, the process proceeds to a step S7, wherein the deck 28 is set to be unselectable (that is, the deck key 1216 is displayed in a non-selectable state in the screen shown in FIG. 15). The steps S6 and S7 are also executed for the manual feed tray 27, followed by terminating the present process.

On the other hand, if it is determined in the step S3 that the selected discharge tray is not the face-up tray 2, but the face-down tray 3, it is determined in a step S8 whether or not the cassette 21*a* contains a reverse tab sheet bundle, and if the cassette 21*a* contains a reverse tab sheet bundle, the process proceeds to a step S10, whereas if the cassette 21*a* does not contain a reverse tab sheet bundle, the process proceeds to a step S9, wherein the cassette 21*a* is set to be unselectable (that is, the cassette 1 key 1212 is displayed in a non-selectable state in the screen shown in FIG. 15). The steps S8 and S9 are also repeatedly executed for the cassettes 21*b* to 21*d*.

Next, it is determined in the step S10 whether or not the deck 28 contains a normal tab sheet bundle, and if it is determined that the deck 28 contains a normal tab sheet bundle, the present process is immediately terminated, whereas if the deck 28 does not contain a normal tab sheet bundle, the process proceeds to a step S11, wherein the deck 28 is set to be unselectable (that is, the deck key 1216 is displayed in a non-selectable state in the screen shown in FIG. 15). The steps S10 and S11 are also executed for the manual feed tray 27.

On the other hand, in the step S12 in FIG. 17, it is determined whether or not a feed tray has been selected. If no feed tray is selected, the present process is immediately terminated.

On the other hand, if it is determined in the step S12 that a feed tray has been selected, it is determined in a step S13 whether or not the selected feed tray is a cassette. If it is determined the selected feed tray is a cassette, it is determined in a step S14 whether or not the cassette contains a normal tab sheet bundle, and if the cassette contains a normal tab sheet bundle, the face-down tray 3 is set to be unselectable (that is, the face-down tray key 1003) is displayed in a non-selectable state in the screen shown in FIG. 10B) in a step S15, followed by terminating the present process.

On the other hand, in the step S14, it is determined that the selected cassette does not contain a normal tab sheet bundle, the face-up tray 2 is set to be unselectable (that is, the face-up tray key 1001 is displayed in a non-selectable state in the screen shown in FIG. 10B) in a step S16, followed by terminating the present process.

On the other hand, if it is determined in the step S13 that the selected feed tray is not a cassette, in other words, the selected feed tray is the deck 28 or the manual feed tray 27, it is then determined in a step S17 whether or not the deck 28 or the manual feed tray 27 contains a normal tab sheet bundle. If the deck 28 or the manual feed tray 27 contains a normal tab sheet bundle, the face-up tray 2 is set to be unselectable (that is, the face-up tray key 1001 is displayed in a non-selectable state in the screen shown in FIG. 10B) in a step S18, followed by terminating the present process.

On the other hand, if it is determined in the step S17 that the selected deck 28 or manual feed tray 27 does not contain a normal tab sheet bundle, the face-down tray 3 is set to be unselectable (that is, the face-down tray key 1003 is displayed in a non-selectable state in the screen shown in FIG. 10B) in a step S19, followed by terminating the present process.

If the user newly selects a discharge tray or a feed tray, the selection-inhibiting settings for the discharge trays or the feed trays described above is canceled, and the above process described with reference to the flowchart shown in FIGS. 16 and 17 is again executed concerning the newly selected discharge tray or feed tray.

The variation of the tab sheet mode process described above can be summarized as follows: The CPU, not shown, of the controller section CONT appearing in FIG. 1 is responsive to selection of the face-up tray 2 that receives each tab sheet of a tab sheet bundle discharged in a face-up state, for inhibiting selection of feed trays other than the cassettes 21*a* to 21*d* in which a tab sheet bundle in a normal page order is set and from which each tab sheet of a tab sheet bundle is fed via a conveying path via which the tab sheet is conveyed while being inverted, to an image transfer position, and the deck 28 and the manual feed tray 27 in which a tab sheet bundle in a reverse page order is set and from which each tab sheet is conveyed without being inverted, to the image transfer position (in other words, inhibiting selection of the cassettes 21*a* to 21*d* in which a tab sheet bundle in a reverse page order is set and the deck 28 and the manual feed tray 27 in which a tab sheet bundle in a normal page order is set). Further, the CPU of the controller section CONT is responsive to selection of the face-down tray 3 that receives each tab sheet of a tab sheet bundle discharged in a face-down state, for inhibiting selection of feed trays other than the cassettes 21*a* to 21*d* in which a tab sheet bundle in a reverse page order is set and the deck 28 and the manual feed tray 27 in which a tab sheet bundle in a normal page order is set (in other words, inhibiting selection of the cassettes 21*a* to 21*d* in which a tab sheet bundle in a normal page order is set and the deck 28 and the manual feed tray 27 in which a tab sheet bundle in a reverse page order is set). Further, the CPU of the controller section CONT is responsive to selection of any of the cassettes 21*a* to 21*d* in which a tab sheet bundle in a normal page order is set or either of the deck 28 or the manual feed tray 27 in which a tab sheet bundle in a reverse page order is set, for inhibiting selection of a discharge tray other than the face-up tray 2 (that is, inhibiting selection of the face-down tray 3), and responsive to selection of any of the cassettes 21*a* to 21*d* in which a tab sheet bundle in a reverse page order is set or either of the deck 28 or the manual feed tray 27 in which a tab sheet bundle in a normal page order is set, for inhibiting selection of a discharge tray other than the face-down tray 3 (that is, inhibiting selection of the face-up tray 2). This makes it possible to set up a tab sheet mode-operating and configuring environment in which an effective tab sheet mode output can be obtained by a simple designating operation, without the user being conscious of manners of output of the tab sheets dependent on tab sheet setting, thereby limiting wasteful image formation due to errors in a tab sheet mode process as occurring in the prior art, to save paper resources.

Hereafter, a description will be given of a data processing program that can be read by the image forming apparatus according to the present embodiment, by referring to a memory map shown in FIG. 18.

FIG. 18 is a diagram useful in explaining the structure of a memory map of a storage medium that stores various data processing programs which can be read out by the image forming apparatus shown in FIG. 1.

Although not specifically shown, the storage medium sometimes also stores information for managing a group of control programs stored in the storage medium, such as information of versions of the programs, and creators of the same, and at the same time, information dependent on an OS (operating system) that reads out the programs, such as icons discriminatively representing the programs.

Further, data subordinate to the programs are also managed in a directory defined by the memory map. Further, in a case where a program for installing various programs in a computer, or programs to be installed are in a compressed format, a program for expanding the compressed data may also be stored in the memory medium.

The functions of the image forming apparatus according to the present embodiment described hereinbefore with reference to FIGS. 9, 16, and 17 may be executed by a host computer, based on a program externally installed on the computer. In this case, the present invention is applicable to a case where a group of information including the program code is supplied to an input device of the host computer from a storage medium, such as a CD-ROM, a flash memory, and an FD, or from an internal storage medium via a network. More specifically, a printer driver installed on the host computer may provide the control described hereinabove according to the flowchart shown in FIG. 9 or FIGS. 16 and 17.

It is to be understood that the object of the present invention may also be accomplished by supplying a system or an apparatus with a storage medium in which a program code of software which realizes the functions of the above described embodiment or variation is stored, and causing a computer (or CPU or MPU) of the system or apparatus to read out and execute the program code stored in the storage medium.

In this case, the program code itself read from the storage medium realizes the functions of the above described embodiment or variation, and hence the storage medium on which the program code is stored constitutes the present invention.

Examples of the storage medium for supplying the program code include a floppy (registered trademark) disk, a hard disk, an optical disk, a magneto-optical disk, a CD-ROM, a CD-R, a CD-RW, a DVD-ROM, a DVD-RAM, a DVD–RW, a DVD+RW, a magnetic tape, a nonvolatile memory card, and a ROM. Further, the program code may be downloaded via a network.

Further, it is to be understood that the functions of the above described embodiment or variation may be accomplished not only by executing a program code read out by a computer, but also by causing an OS (operating system) or the like which operates on the computer to perform a part or all of the actual operations based on instructions of the program code.

Further, it is to be understood that the functions of the above described embodiment or variation may be accomplished by writing the program code read out from the storage medium into a memory provided in an expansion board inserted into a computer or in an expansion unit connected to the computer and then causing a CPU or the like provided in the expansion board or the expansion unit to perform a part or all of the actual operations based on instructions of the program code.

What is claimed is:

1. An image forming apparatus capable of feeding tab sheets of a predetermined tab sheet bundle or other sheets than the tab sheets, comprising:

a first sheet feed device that feeds each of the tab sheets of the predetermined tab sheet bundle or the other sheets to an image transfer position via a first conveying path with the sheet being inverted;

a second sheet feed device that feeds each of the tab sheets of the predetermined tab sheet bundle or the other sheets to the image transfer position via a second conveying path without each sheet being inverted;

a first sheet discharge device that discharges each of the tab sheets of the predetermined tab sheet bundle or the other sheets in a face-up state;

a second sheet discharge device that discharges each of the tab sheets of the predetermined tab sheet bundle or the other sheets in a face-down state;

a designating device that designates a type of sequence of tabs of each of tab sheet bundles set in said first sheet feed device and said second sheet feed device; and a determining device responsive to a user's instruction for feeding tab sheets and selection of a combination of one of said first sheet feed device and said second sheet feed device and one of said first sheet discharge device and said second sheet discharge device, for determining whether a combination of the selected one of said first sheet feed device and said second sheet feed device, the selected one of said first sheet discharge device and said second sheet discharge device, and the type of sequence of tabs of the tab sheet bundle set in the selected one of said first sheet feed device and said second sheet feed device is valid or not.

2. An image forming apparatus as claimed in claim 1, further comprising a control device that controls, based on a result of the combination-validity determination by said determining device, whether to allow or inhibit image forming according to the user's selection of the combination of the one of said first sheet feed device and said second sheet feed device and the one of said first sheet discharge device and said second sheet discharge device.

3. An image forming apparatus capable of feeding tab sheets of a predetermined tab sheet bundle or other sheets than the tab sheets, comprising:

a first sheet feed device that feeds each of the tab sheets of the predetermined tab sheet bundle or the other sheets to an image transfer position via a first conveying path with the sheet being inverted;

a second sheet feed device that feeds each of the tab sheets of the predetermined tab sheet bundle or the other sheets to the image transfer position via a second conveying path without each sheet being inverted;

a first sheet discharge device that discharges each of the tab sheets of the predetermined tab sheet bundle or the other sheets in a face-up state;

a second sheet discharge device that discharges each of the tab sheets of the predetermined tab sheet bundle or the other sheets in a face-down state;

a designating device that designates a type of sheets set in said first sheet feed device or said second sheet feed device, and when the designated type of sheets is a tab sheet bundle, designates a type of sequence of tabs of the tab sheet bundle; and a determining device responsive to a user's instruction for feeding tab sheets and selection of a combination of one of said first sheet feed device and said second sheet feed device and one of said first sheet discharge device and said second sheet discharge device, for determining whether a combination of the selected one of said first sheet feed device and said second sheet feed device, the selected one of said first sheet discharge device and said second sheet discharge device, and the type of sequence of tabs of the tab sheet bundle set in the selected one of said first sheet feed device and said second sheet feed device is valid or not.

4. An image forming apparatus as claimed in claim 3, further comprising a control device that provides control to decide whether to allow or inhibit image forming according to the user's selection of the combination of the one of said first sheet feed device and said second sheet feed device and the one of said first sheet discharge device and said second sheet discharge device, based on a result of the combination-validity determination by said determining device.

5. An image forming apparatus capable of feeding tab sheets of a predetermined tab sheet bundle or other sheets than the tab sheets, comprising:

a first sheet feed device that feeds each of the tab sheets of the predetermined tab sheet bundle or the other sheets to an image transfer position via a first conveying path with the tab sheet being inverted;

a second sheet feed device that feeds each of the tab sheets of the predetermined tab sheet bundle or the other sheets to the image transfer position via a second conveying path without each sheet being inverted;

a first sheet discharge device that discharges each of the tab sheets of the predetermined tab sheet bundle or the other sheets in a face-up state;

a second sheet discharge device that discharges each of the tab sheets of the predetermined tab sheet bundle or the other sheets in a face-down state;

a designating device that designates a type of sequence of tabs of each of tab sheet bundles set in said first sheet feed device and said second sheet feed device; and a determining device responsive to a user's instruction for feeding tab sheets and selection of one of said first sheet feed device and said second sheet feed device, for determining which of said first sheet discharge device and said second sheet discharge device is allowed to be selected by a user, according to the selected one of said first sheet feed device and said second sheet feed device and the type of sequence of tabs of the tab sheet bundle set in the selected one of said first sheet feed device and said second sheet feed device.

6. An image forming apparatus capable of feeding tab sheets of a predetermined tab sheet bundle or other sheets than the tab sheets, comprising:

a first sheet feed device that feeds each of the tab sheets of the predetermined tab sheet bundle or the other sheets to an image transfer position via a first conveying path while each sheet is inverted;

a second sheet feed device that feeds each of the tab sheets of the predetermined tab sheet bundle or the other sheets to the image transfer position via a second conveying path without with the sheet being inverted;

a first sheet discharge device that discharges each of the tab sheets of the predetermined tab sheet bundle of the predetermined tab sheet bundle or the other sheets in a face-up state;

a second sheet discharge device that discharges each of the tab sheets of the predetermined tab sheet bundle of the predetermined tab sheet bundle or the other sheets in a face-down state;

a designating device that designates a type of sequence of tabs of each of tab sheet bundles set in said first sheet feed device and said second sheet feed device; and a determining device responsive to a user's instruction for feeding tab sheets and selection of one of said first sheet discharge device and said second sheet discharge device, for determining which of said first sheet feed device and said second sheet feed device is allowed to be selected by a user, according to the selected one of said first sheet discharge device and said second sheet discharge device and the type of sequence of tabs of each of the tab sheet bundles set in said first sheet feed device and said second sheet feed device.

7. An image forming apparatus capable of sequentially feeding tab sheets of a tab sheet bundle in a normal order or a reverse order, comprising:

a first sheet feed device that feeds each of the tab sheets of the tab sheet bundle to an image transfer position via a first conveying path while the tab sheet is inverted;

a second sheet feed device that feeds each of the tab sheets of the tab sheet bundle to the image transfer position via a second conveying path without the tab sheet being inverted;

a first sheet discharge device that discharges each of the tab sheets of the tab sheet bundle in a face-up state;

a second sheet discharge device that discharges each of the tab sheets of the tab sheet bundle in a face-down state; and a control device responsive to selection of said first sheet discharge device, for inhibiting selection of feed devices other than said first sheet feed device in which the tab sheet bundle in the normal order is set and said second sheet feed device in which the tab sheet bundle in the reverse order is set.

8. An image forming apparatus capable of sequentially feeding tab sheets of a tab sheet bundle in a normal order or a reverse order, comprising:

a first sheet feed device that feeds each of the tab sheets of the tab sheet bundle to an image transfer position via a first conveying path while the tab sheet is inverted;

a second sheet feed device that feeds each of the tab sheets of the tab sheet bundle to the image transfer position via a second conveying path without the tab sheet being inverted;

a first sheet discharge device that discharges each of the tab sheets of the tab sheet bundle in a face-up state;

a second sheet discharge device that discharges each of the tab sheets of the tab sheet bundle in a face-down state; and a control device responsive to selection of said second sheet discharge device, for inhibiting selection of feed devices other than said first sheet feed device in which the tab sheet bundle in the reverse order is set and said second sheet feed device in which the tab sheet bundle in the normal order is set.

9. An image forming apparatus capable of sequentially feeding tab sheets of a tab sheet bundle in a normal order or a reverse order, comprising:

a first sheet feed device that feeds each of the tab sheets of the tab sheet bundle to an image transfer position via a first conveying path while the tab sheet is inverted;

a second sheet feed device that feeds each of the tab sheets of the tab sheet bundle to the image transfer position via a second conveying path without the tab sheet being inverted;

a first sheet discharge device that discharges each of the tab sheets of the tab sheet bundle in a face-up state;

a second sheet discharge device that discharges each of the tab sheets of the tab sheet bundle in a face-down state; and a control device responsive to selection of said first sheet feed device in which the tab sheet bundle in the normal order is set or said second sheet feed device in which the tab sheet bundle in the reverse order is set, for inhibiting selection of discharge devices other than said first sheet discharge device.

10. An image forming apparatus capable of sequentially feeding tab sheets of a tab sheet bundle in a normal order or a reverse order, comprising:

a first sheet feed device that feeds each of the tab sheets of the tab sheet bundle to an image transfer position via a first conveying path while the tab sheet is inverted;

a second sheet feed device that feeds each of the tab sheets of the tab sheet bundle to the image transfer position via a second conveying path without the tab sheet being inverted;

a first sheet discharge device that discharges each of the tab sheets of the tab sheet bundle in a face-up state;

a second sheet discharge device that discharges each of the tab sheets of the tab sheet bundle in a face-down state; and a control device responsive to selection of said first sheet feed device in which the tab sheet bundle in the reverse order is set or said second sheet feed device in which the tab sheet bundle in the normal order is set, for inhibiting selection of discharge devices other than said second sheet discharge device.

* * * * *

UNITED STATES PATENT AND TRADEMARK OFFICE

CERTIFICATE OF CORRECTION

PATENT NO. : 6,937,829 B2
DATED : August 30, 2005
INVENTOR(S) : Mitsuhiko Sato et al.

It is certified that error appears in the above-identified patent and that said Letters Patent is hereby corrected as shown below:

Column 26,
Line 2, the word "tab" is to be deleted.

Signed and Sealed this

Twenty-fifth Day of October, 2005

JON W. DUDAS
*Director of the United States Patent and Trademark Office*